United States Patent [19]

Ogawa et al.

[11] Patent Number: 4,894,321

[45] Date of Patent: Jan. 16, 1990

[54] PHOTOGRAPHIC SUPPORT AND COLOR PHOTOSENSITIVE MATERIAL

[75] Inventors: Tadashi Ogawa, Minami-Ashigara; Tetsuro Fuchizawa, Fujinomiya; Masaru Sano, Minami-Ashigara; Seiichi Taguchi, Minami-Ashigara; Keisuke Shiba, Minami-Ashigara, all of Japan

[73] Assignee: Fuji Photo Film Co., Ltd., Minami-Ashigara, Japan

[21] Appl. No.: 73,767

[22] Filed: Jul. 15, 1987

[30] Foreign Application Priority Data

Jul. 17, 1986 [JP] Japan ..... 61-168801
Jul. 17, 1986 [JP] Japan ..... 61-168803

[51] Int. Cl.[4] ..... G03C 1/87

[52] U.S. Cl. ..... 430/496; 430/523; 430/524; 430/526; 430/929; 430/933; 430/950

[58] Field of Search ..... 430/496, 523, 524, 526, 430/929, 933, 950

[56] References Cited

U.S. PATENT DOCUMENTS 3,222,178 12/1965 Nadeau et al. ..... 430/524
3,833,380 9/1974 Crawford et al. ..... 430/523
4,264,707 4/1981 Uozumi et al. ..... 430/526
4,465,767 8/1984 Oba et al. ..... 430/526
4,562,140 12/1985 Kohmura et al. ..... 430/496
4,601,976 7/1986 Karino ..... 430/496

FOREIGN PATENT DOCUMENTS 48853 3/1986 Japan .
27050 of 1903 United Kingdom .

*Primary Examiner*—Paul R. Michl
*Assistant Examiner*—Mark R. Buscher
*Attorney, Agent, or Firm*—Burns, Doane, Swecker & Mathis

[57] ABSTRACT

The present invention relates to a photographic support comprising, on a substrate, a filling layer comprising a fine solid powder having the stationary diffuse-reflective surface and a color photosensitive material comprising at least one silver halide emulsion layer formed on the secondary diffuse-reflective surface of a filling layer comprising a solid powder formed on a substrate. A photographic support of the present invention provides an image having remarkably improved brightness, saturation, tone reproducibility in shade areas and sharpness. A printing color photosensitive material of the present invention provides an image having remarkably improved brightness, saturation, tone reproducibility in shades and sharpness and also capable of rigid development.

19 Claims, 5 Drawing Sheets

PHOTOGRAPHIC SUPPORT AND COLOR PHOTOSENSITIVE MATERIAL

FIELD OF THE INVENTION

The present invention relates to a photographic support capable of providing an excellent image. In particular, the present invention relates to a photographic support capable of providing an image having remarkably improved brightness, saturation, tone reproducibility in shade areas and sharpness.

The present invention relates also to a color photosensitive material capable of providing an excellent color image. In particular, the present invention relates to a color photosensitive material for prints capable of providing an image having remarkably improved brightness, saturation, tone reproducibility in shades and sharpness and also capable of rapid development.

BACKGROUND OF THE INVENTION

Transparent plastic films such as TAC and PET films are known as photographic supports, and papers, synthetic papers, plastic films containing a white pigment, glass plates and metal plates (such as an aluminum plate having a surface processed by anodic oxidation) are known as reflective materials. To improve the whiteness of the support, it has been proposed to mix or to incorporate a fine powder of a metal oxide or an inorganic compound (such as titanium oxide, barium sulfate or magnesium oxide) as a sizing agent in the surface layer of the support. However, when the whiteness of the support is increased, the sharpness of the image is usually reduced, while the white reproducibility is improved. To solve this problem, it has been proposed to incorporate an anti-irradiation dye in a silver halide-containing photosensitive layer provided on the support or to provide an antihalation layer.

Further, so-called Daguerreotype has been known since the early nineteenth century. In this method, gaseous iodine is sprayed over a well polished silver plate to form an AgI layer by the chemical reaction and the development is conductd with gaseous mercury after the image exposure to form a photographic image. However, this method has defects that, since the silver plate used as a support is not well prepared and it is subjected directly to the chemical processes, the surface of the silver plate is stained and its initial mirror plane cannot be maintained and that since the silver/mercury image is deposited directly on the silver surface to mask the surface, the obtained image has only poor brightness and sharpness.

When a photographic material comprising ordinary emulsion layers formed on an aluminum support having the surface having a metallic gloss which highly reflects the light is used, the obtained image is only slightly lighter than that obtained by using a baryta paper. When microcapsules of a silver halide emulsion are applied to the support to form a single layer, bright transparent grains could be seen (see, for example, Japanese Patent Publication No. 49-33783). The image thus formed cannot be seen easily due to the reflected light and very small flaws on the surface become conspicuous unfavorably.

Further, it is known to provide an antistatic layer of a metal such as aluminum or chromium by vacuum deposition (for example, British Pat. No. 1340403 and Japanese Patent Publication Nos. 59-41573 and 59-10420). However, these publications are silent on the improvement in or relating to the reproduction of the images and they have no relation with the present invention.

Ordinary color photosensitive materials comprise, on a support (such as a film, film containing a white pigment, paper, e.g. baryta paper or paper having water-resistant resin layers on both surfaces), an antihalation layer, red-sensitive layer, green-sensitive layer, yellow filter layer, blue-sensitive layer, protective layer, etc. suitably. To form an excellent color image, investigations were made in or relating to transparency and reduction in the thickness of the layers, layer structure, prevention or irradiation or halation, spectral absorbing characters of colored dyes prepared from color couplers and transparency of the material. For improving particularly the sharpness, the silver halide emulsions such as halogen compositions and grain size are selected so as to exhibit the interlayer effects in the development, and investigations of the layer structure are made. It was proposed also that a material which releases a compound having an effect of inhibiting or accelerating the development in the color develpment step is used. However, they are yet insufficient particularly when a color image is formed on a reflective support such as a color photographic printing paper.

It is known that a bright image can be obtained by using a photosensitive material prepared by applying microcapsules of a silver halide emulsion on an aluminum substrate surface which reflects a light well and which has a metallic gloss (see, for example, Japanese Patent Publication No. 49-33783). However, although the brightness of the image thus obtained by using the photosensitive material comprising on the aluminum support, a laminate of ordinary emulsion layers is improved slightly, it is yet unsatisfactory. It is known also that the image thus formed cannot be seen easily due to the reflected light and that very small flaws on the surface become conspicuous unfavorably. A lithographic plate comprising, on an aluminum support, silver halide emulsion layers is known (see, for example, British Pat. No. 1227603 nd Japanese Patent Public Disclosure No. 54-90053). The aluminum support used in the lithography has the surface processd by, for example, graining and, therefore, it does not have the above-described effects. Under these circumstances, processes for overcoming the defects by, for example, preventing the halation have been proposed (for example, Japanese Patent Public Disclosure No. 54-124927). Further, color image-forming materials do not have these effects. It is also known that a layer of a metal such as aluminum or chromium is formed by vacuum desposition for obtaining antistatic effects (for example, British Pat. No. 130403, and Japanese Patent Publication Nos. 59-41573 and 59-10420). However, they are silent on the improvement of the color image and they have no relation with the present invention.

SUMMARY OF THE INVENTION

The first object of the present invention is to improve the brightness and saturation of an image and particularly to widen the angle at which the image can be observed well. The second object is to improve the sharpness of the image to an extent that could not be attained in the prior art. The third object is to provide a color photographic material capable of forming an excellent color image having a saturation and gradation reproduction in shades improved to an extent that could not be attained in the prior art. The fourth object of the present invention is to provide a color photographic material capable of forming a color image having a remarkably improved sharpness particularly in a high frequency region. The fifth object of the present invention is to provide a color photographc material which has the above-mentioned properties and which can be processed by an ordinary color photographic developing process, particulary a rapid process. Other objects of the present invention will be apparent from the description in this specification.

The objects of the present invention are attained by a photographic support having a secondary diffuse-reflective surface or by a photographic support comprising, on a substrate, a filling layer comprising fine solid powder having a secondary diffuse-reflective surface.

Further, the objects of the present invention are attained by a color photosensitive material having at least one silver halide emulsion layer formed on the surface of a photogrphic support comprising, on a substrate, a filling layer comprising a solid powder having the secondary diffuse-reflective surface.

Another embodiment of the invention relates to a photographic support having on a substrate, a filling layer with a secondary diffuse-reflective surface, wherein a thermoplastic resin layer or an adhesive is provided between the solid powder filling layer and the substrate. Similarly, even another emodiment is directed to such a support which further includes a thermoplastic resin layer or a water-resistant resin layer provided on the surface of the substrate opposite to the surface thereof having the filling layer.

DETAILED DESCRIPTION OF THE INVENTION

Figure 1:
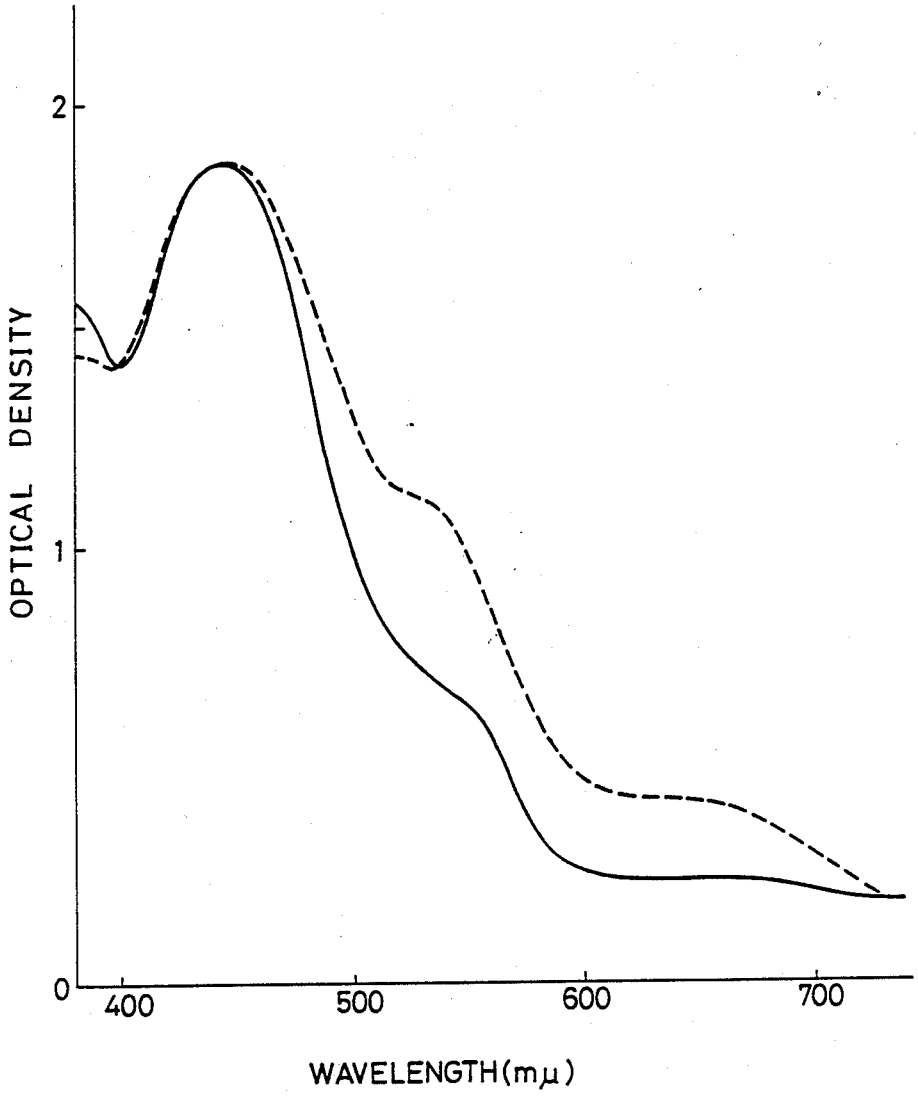
FIGS. 1 to 3 show spectral absorption curves.

Now, the detailed description will be made on the color photosensitive material of the present invention.

Photographic Support

The reflection on the surfaces of the substances are usually roughly classified into a mirror reflection and diffuse reflection. Further, the diffuse reflection can be classified into the primary diffuse reflection and the secondary diffuse reflection. The mirror reflection is the reflection on a smooth surface according to the regular reflection law. The diffuse reflection is observed on the surfaces of papers, coatings, woods and walls, wherein incident light reflects not only regularly but also irregularly on the surface.

The secondary diffuse reflection is observed on all the surfaces having minute slant boundaries such as the surface of a ground glass or abraded metal surface. The term "secondary diffuse-reflection" herein indicates a reflection occurring on a smooth mirror surface but on which very small unevennesses are provided to form boundaries thereon. The diffuse-reflected light can be deemed as a collection of regularly reflected lights on the respective, very small reflection surfaces. This is why the secondary diffuse reflection is called "(collected) reflections on small mirror planes" as defined in paragraph 1, chapter 18 in "Shikisai Kagaku Handbook" Edition 5 edited by Nippon Shikisai Gakkai and published by Tokyo Daigaku Shuppan-kai in 1985.

The primary diffuse reflection can be distinguished from the secondary diffuse reflection by a difference in the reflectance R. The term "secondary diffuse reflection" herein indicates that the reflectance R is at least 0.5. Therefore, the secondary diffuse-reflective surface according to the present invention has the reflectance R of at least 0.5, preferably 0.7 to 1.0. The reflectance R of a light of rectangular irradiation on the smooth surface of a given material can be determined by means of a spectrophotometer. The secondary diffuse-reflective surface can also be estimated, according to the total reflection measured by a spectrophotometer having an integrating shere. The term "primary diffuse reflection" means that when a light-transmitting solid is finely pulverized and irradiated with a light, the incident light is diffused by the total reflection or the reflection on a part of the surface.

The mirror reflection can be distinguished from the diffuse reflection according to a difference in the spectral reflectance. The spectral reflectance is determined as follows:

Monochromatic light of 550 nm is directed at an angle of 7° from normal line of a sample. A regular reflection fraction is eliminated by providing a trap located at a circumferential angle of 10° from center of incident light and fraction ranging within a circumferential angle of 90° from normal line other than the fraction eliminated by the trap are integrated by an integrating shere. The spectral reflectance is shown by percentage on the basis of incident light. The secondary diffuse-reflection in the present invention indicates that the spectral reflectance (determined with a monochromatic light of 550 nm) is at least 5%. Therefore, the secondary diffuse-reflective surface according to the present invention has a spectral reflectance (monochromatic light of 550 nm) of at least 5%, preferably at least 10% and more preferably at least 20%. The spectral reflectance can be determined with, for example, Color Analyzer 307 of Hitachi, Ltd. A monochromatic light of 550 nm is employed as a typical light in green region having a high visual sensitivity in the present invention. The determination is conducted using a resin free of a dye or pigment so as to accurately determine the spectral reflectivity of the secondary diffuse-reflective material.

Thus, the secondary diffuse-reflection of the present invention can be distinguished from the mirror reflection or the primary diffuse-reflection according to a difference in the reflectance R of the light of the rectangular irradiation on the surface-constituting material and the spectral reflectance determined by means of a spectrophotometer such as the above-mentioned Hitachi Color Analyzer with the trap. The filling layer comprising the solid powder providing the secondary diffuse-reflective surface comprises the solid powder and a resin.

The solids are preferably metals. The metals include, for example, those described on pages 174 to 184 of F. Benford et al., J. Opt. Soc. Amer., 32 (1942) such as silver, aluminum, gold, copper, chromium, nickel, platinum and alloys of them, e.g. aluminum/magnesium alloy, aluminum/copper alloy, aluminum/antimony alloy and brass.

In addition to the solid powder, powders of inorganic substances are also preferably used. The inorganic substances include, for example, natural mica scales and fish scales.

To provide the secondary diffuse reflective surface of the filling layer of the solid powder, the average particle diameter of the solid powder is preferably about 0.01 to 1,000μ in the present invention. Particularly, the average particle diameter of silver is preferably 0.1 to 100μ and that of gold is preferably 0.01 to 100μ.

Examples of resins include water-soluble high molecular substances (such as gelatin), aqueous latexes (such as styrene/butadiene, acrylonitrile/butadiene, acrylic, styrene/acrylic/vinylidene chloride, vinyl acetate/vinyl chloride and ethylene/vinyl acetate), organic solvent resins (such as acrylic, polyester, cellulose, polystyrene, polyvinyl chloride and polyvinyl acetate) and thermoplastic resins (such as polyethylene and polypropylene).

The photographic support of the present invention can be prepared by mixing the above-mentioned resin with the above-mentioned solid powder, applying the mixture to a substrate by a known method with, for example, a knife coater and, if necessary, drying it. It is preferred to coat the grains of the solid powder with the resin prior to the mixing of them.

In another method, a photopolymerizable monomer or oligomer (such as acryloyl, methacryloyl or acrylamide compound having a double bond; a compound having an allyl group, vinyl ether group or vinyl thioether group; or an unsaturated polyester compound having a molecular weight of 1,000 to 20,000) is mixed with the above-mentioned solid powder and the obtained mixture is applied to the substrate, which is irradiated with electron rays or the like to form a film. Compounds decribed in, for example, "Kankosei Jushi Data-shu" (Photosensitive Resin Data) published by Sogo Kagaku Kenkyu-jo in 1968, pp. 235 to 236 and Francken, 'Fatipec Congress', Vol. 11, No. 19 (1972) are suitably used as the photopolymerizable monomer or oligomer.

The outer surface unevennesses can be examined by embedding and fixing a sample in a resin, cutting the obtained product according to ultramicrotomy and observing the section of the piece with an electron microscope. The surface unevennesses can be determined directly with a sectional shape-measuring device by the irradiation with electron rays. The degree of accuracy is up to submicrons. The number of unevennesses can be determined in terms of the frequency of the surface roughness. The average frequency is preferably 0.1 to 2000/mm and more preferably 1 to 1000/mm.

When the support of the present invention is used, the visual angle in the observation of the image is widened and the light source is enlarged from points into planes to provide a clearer image. The visual angle can be optimized, according to the directivity of reflected light from the surface. Further, the brightness in the highlights in the image, saturation of the image and the reproducibility of the gradation in shadows are remarkably improved. In addition, the sharpness of the image is surprisingly improved.

The substrates of the supports of the present invention may be those usually used heretofore such as plastic films, papers, RC-papers, synthetic papers and metal plates. Among them, papers and RC-papers are preferred. An aluminum foil having the unevennesses previously provided according to the present invention can be laminated with the RC paper having a low-density polyethylene layer. The thickness of the support is preferably from 50 to 300 μm.

A silver halide emulsion layer can be formed on the support of the present invention via a prime layer. The prime layer comprises a thermoplastic resin such as polyethylene or polypropylene or an ionomer resin containing an epoxy adhesive. A gelatin or gelatin/silver halide emulsion layer can be formed thereon after corona discharge process or without this process.

The prime layer has effects of increasing the adhesion of the silver halide emulsion layer and inhibiting harmful effects of the support on the silver halide emulsion layer such as spot formation, fogging and deterioration of the storage stability. The prime layer is formed uniformly and it is preferably thin. The thickness of the layer is less than 5μ, preferably less than 2μ.

If necessary, a small amount (such as 1 g/m$^2$ or less) of fine grains having the primary diffuse-reflecting properties can be incorporated in the layers such as the prime layer or, alternatively, fine dispersed particles of a latex or a high-boiling organic solvent having the primary diffuse-reflecting properties can be incorporated therein.

Further, it is also possible to incorporate a fine powder of titanium oxide or barium sulfate in the substrate, and pores are provided in the thin metal film layer provided on the surface thereof according to the present invention to partially replace the secondary diffuse-reflection with the primary diffuse-reflection. As a result, the visual angle of the observation can be widened without reducing the sharpness.

The support of the present invention is usable widely as a photographic reflective support. It is possible to form a silver halide emulsion layer for black-and-white printing paper on the support, via a prime layer if necessary, and to form a protective layer thereon. Further, a photosensitive material for color photographic paper can be prepared by forming two or more photosensitive silver halide emulsion layers having different spectral sensitivities and containing different color couplers, which emulsions are the same as those used in the preparation of ordinary color photographic papers. The support of the present invention is usable for the preparation of reversal color photosensitive materials, color photographic papers of direct positive type and color copying materials of direct positive type by photo-fogging method. The support of the present invention is usable also for the preparation of printing photosensitive materials of SDB system by forming on the support, red-sensitive, green-sensitve and blue-sensitive silver halide emulsion layers each comprising silver halide grains having a different spectral sensitivity and a dye usable in silver dye bleech (SDB) method.

A mordanting layer can be formed on the support of the present invention to prepare a material for forming a color image by diffusing a color coupling off dye and transferring it. Physical development centers can be provided in the priming layer on the support of the present invention to prepare a silver image-forming material of silver diffuse transfer type.

The photographic support of the present invention can be used for the preparation of heat development-type photosensitive materials and/or dye-fixing materials (image-receiving materials) described in U.S. Pat. No. 4,500,626, Japanese Patent Public Disclosure Nos. 60-133449 and 59-218443 and Japanese Patent Application No. 60-79709.

Silver Halide Emulsion Layers

At least one silver halide emulsion layer is formed on the secondary diffuse-reflective surface of the support in the present invention.

The description will be made on the silver halide emulsion layers.

(a) Silver halide emulsion layer RL: This layer mainly comprises silver halide grains having a spectral sensitivity in a wavelength region of 580 to 700 mμ and a cyan coupler. The cyan couplers contained in the RL layer are classified into oil-protecting naphthol couplers and phenol couplers. Typical examples of the naphthol couplers include those described in U.S. Pat. No. 2,474,293 and preferably oxygen-linked coupling-off type 2-equivalent naphthol couplers described in U.S. Pat. Nos. 4,052,212, 4,146,396, 4,228,233 and 4,296,200. Examples of the phenol couplers are described in U.S. Pat. Nos. 2,369,929, 2,801,171, 2,772,162 and 2,895,826. Cyan couplers having excellent fastness to humidity and temperature are preferably used in the present invention. Typical examples of them include phenolic cyan couplers having an alkyl group higher than ethyl group inclusive at m-position of the phenol nucleus as described in U.S. Pat. No. 3,772,002, 2,5-diacrylamino-substituted phenolic couplers described in U.S. Pat. Nos. 2,772,162, 3,758,308, 4,126,396, 4,334,011 and 4,327,173, West German Patent Public Disclosure No. 3,329,729 and European Pat. No. 121,365 and phenolic couplers having a phenylureido group at position 2 and an acylamino group at position 5 as described in U.S. Pat. Nos. 3,446,622, 4,333,999, 4,451,559 and 4,427,767.

The couplers of the following general formulae (I) and (II) are particularly preferred:

general formula (I):

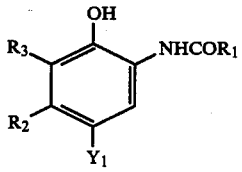

general formula (II):

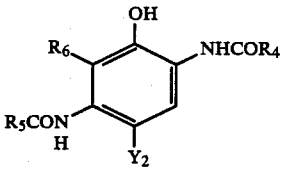

(b) Silver halide emulsion layer GL: This layer mainly comprises silver halide grains having a spectral sensitivity in a wavelength region of 500 to 580 mμ and a magenta coupler. Examples of the magenta couplers contained in GL include oil-protecting type indazolone couplers, cyanoacetyl couplers and preferably 5-pyrazolone couplers and pyrazoloazole couplers such as pyrazolotriazole. Among the 5-pyrazolone couplers, those having an arylamino group or acrylamino group at position 3 are preferred from the viewpoint of the colored dye or the color density. Typical examples of them are described in U.S. Pat. Nos. 2,311,082, 2,343,703, 2,600,788, 2,908,573, 3,062,653, 3,152,896 and 3,936,015. As the release groups of the 2-equivalent 5-pyrazolone couplers, nitrogen-linked coupling-off group described in U.S. Pat. No. 4,310,619 and arylthio groups described in U.S. Pat. No. 4,351,897 are particularly preferred. When 5-pyrazolone couplers having a ballast group described in European Pat. No. 73,636 are used, a high color density can be obtained.

Examples of the pyrazoloazole couplers include pyrazolobenzimidazoles described in U.S. Pat. No. 3,061,432 and preferably pyrazolo[5,1-c][1,2,4]triazoles described in U.S. Pat. No. 3,725,067 pyrazolotetrazoles described in Research Disclosure No. 24220 (June, 1984) and Japanese Patent Public Disclosure No. 60-33552 and pyrazolopyrazoles described in Research Disclosure No. 24230 (June, 1084) and Japanese Patent Public Disclosure No. 60-43659. Imidazo[1,2-b]pyrazoles described in U.S. Pat. No. 4,500,630 are preferred because of low yellow sub-absorption and excellent light fastness of the developed dye, and pyrazolo[1,5-b][1,2,4]triazole described in U.S. Pat. No. 4,540,654 is particularly preferred.

Couplers of the following general formulae (III) and (IV) are particulary preferred:

general formula (III):

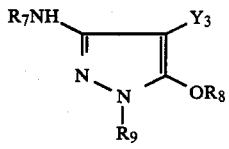

general formula (IV):

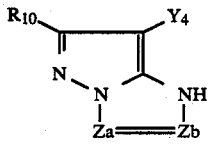

(c) Silver halide emulsion layer BL: This layer mainly comprises silver halide grains having a spectral sensitivity in a wavelength region of 400 to 500 mμ and a yellow coupler. Typical examples of the yellow couplers contained in BL include oil-protecting acylacetamide couplers. Examples of them are described in U.S. Pat. Nos. 2,407,210, 2,875,057 and 3,265,506. 2-equivalent yellow couplers are preferably used in the present invention. They include, for example, yellow couplers of oxygen-linked coupling-off type as described in U.S. Pat. Nos. 3,408,194, 3,447,928, 3,933,501 and 4,022,620 and yellow couplers of nitrogen-linked coupling-off type as described in Japanese Patent Publication No. 58-10739, U.S. Pat. Nos. 4,401,752 and 4,326,024, RD 18053 (April, 1979), British Pat. No. 1,425,020, West German Patent Public Disclosure Nos. 2,219,917, 2,261,361, 2,329,587 and 2,433,812. α-Pivaloylacetanilide couplers are excellent in fastness, particularly light fastness, of the colored dye. α-Benzoylacetanilide couplers provide a high color density.

Couplers of the following general formula (V) are particularly preferred:

general formula (V):

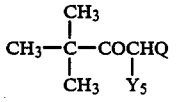

In the above formulae, $R_1$, $R_4$ and $R_5$ each represent an aliphatic group, aromatic group, heterocyclic group, aromatic amino group or heterocyclic amino group, $R_2$ represents an aliphatic group, $R_3$ and $R_6$ each represent a hydrogen atom, halogen atom, aliphatic group, aliphatic oxy group or acylamino group, $R_7$ and $R_9$ each represent a substituted or unsubstituted phenyl group, $R_8$ represents a hydrogen atom, aliphatic or aromatic acyl group or aliphatic or aromatic sulfonyl group, $R_{10}$ represents a hydrogen atom or a substituent, Q represents a substituted or unsubstituted N-phenylcarbamoyl group, Za and Zb each represent a methine, substituted methine or =N—, $Y_1$, $Y_2$ and $Y_4$ each represent a halogen atom or a group which can be released upon the coupling reaction with an oxidation product of a developing agent (hereinafter referred to as release group), $Y_3$ represents a hydrogen atom or a release group, $Y_5$ represents a release group, $R_2$ and $R_3$ or $R_5$ and $R_6$ in the general formulae (I) and (II) may form together a 5-, 6- or 7-membered ring, and a dimer or a higher polymer can be formed through $R_1$, $R_2$, $R_3$ or $Y_1$; $R_4$, $R_5$, $R_6$ or $Y_2$; $R_7$, $R_8$, $R_9$ or $Y_3$; $R_{10}$, Za, Zb or $Y_4$; Q or $Y_5$ the aliphatic group herein being a straight chain, branched or cyclic alkyl, alkenyl or alkynyl group.

The dye-forming couplers and the above-described special couplers may be in the form of dimers or higher polymers. Typical examples of the polymerized dye-forming couplers are described in U.S. Pat. Nos. 3,451,820 and 4,080,211. Typical examples of the polymerized magenta couplers are described in British Pat. No. 2,102,173 and U.S. Pat. No. 4,367,282.

These couplers are dispersed in at least one high-boiling organic solvent and contained in the emulsion layers. High-boiling organic solvents of the following general formulae (A) to (E) are preferably used:

general formula (A):

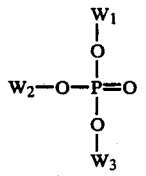

general formula (B):

$W_1—COO—W_2$ general formula (C):

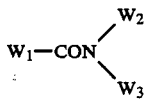

general formula (D):

-continued

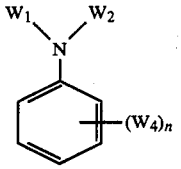

general formula (E):

$W_1—O—W_2$ wherein $W_1$, $W_2$ and $W_3$ each represent a substituted or unsubstituted alkyl, cycloalkyl, alkenyl, aryl or heterocyclic ring, $W_4$ represents $W_1$, $OW_1$, or S-$W_1$ and n represents an integer of 1 to 5, and when n is 2 or larger, the groups $W_4$ may be either the same or different, and $W_1$ and $W_2$ in the general formula (E) may form together a condensed ring.

It is preferred to use a colored coupler in combination with a photographing color sensitive material so as to compensate an unnecessary absorption of a colored dye formed by magenta and cyan coupler in a short wavelength region. Typical examples of them include yellow-colored magenta couplers described in U.S. Pat. No. 4,163,670 and Japanese Patent Publication No. 57-39413, and magenta-colored cyan couplers described in U.S. Pat. Nos. 4,004,929 and 4,138,258 and British Pat. No. 1,146,368.

The standard amount of the color coupler is 0.001 to 1 mol per mol of the photosensitive silver halide, preferably 0.01 to 0.5 mol (yellow coupler), 0.003 to 0.3 mol (magenta coupler) or 0.002 to 0.3 mol (cyan coupler). The standard amount of the color coupler to be applied to a color paper is in the range of 4 to $14\times10^{-4}$, 2 to $8\times10^{-4}$ and 2 to $9\times10^{-4}$ mol/m$^2$ for yellow, magenta and cyan couplers, respectively.

For the spectral sensitization of the silver halide emulsion of the present invention in a given wavelength region, a dye selected from the group consisting of the following dyes can be used: cyanine, merocyanine, complex cyanine, complex merocyanine, holopolar cyanine, hemicyanine, styryl and hemioxonol dyes. Particularly useful dyes are cyanine, merocyanine and complex merocyanine dyes. These dyes may have any of nuclei which are contained in cyanine dyes as basic heterocyclic nuclei. Examples of the nuclei include pyrroline, oxazoline, thiazoline, pyrrole, oxazole, thiazole, selenazole, imidazole, tetrazole and pyridine nuclei; and the nuclei fused with an alicyclic hydrocarbon ring or an aromatic hydrocarbon ring such as indolenine, benzindolenine, indole, benzoxazole, naphthoxazole, benzothiazole, naphthothiazole, benzoselenazole, benzimidazole and quinoline nuclei. These nuclei may have a substituent bonded with the hydrocarbon part.

The merocyanine or complex merocyanine dyes may have a 5- or 6-membered heterocyclic nucleus having a ketomethylene structure such as pyrazolin-5-one, thiohydantoin, 2-thiooxazolidin-2,4-dione, thiazolidin-2,4-dione, rhodanine or thiobarbituric acid nucleus.

These sensitizing dyes may be used either singly or as a combination of them. The combination of the sensitizing dyes is frequently used for the purpose of supersensitization. The emulsion contains, in addition to the sensitizing dye, a dye which per se does not have the spectral sensitization effect or a supersensitizing substance which does substantially not absorb visible rays.

Examples of them include aminostilbene compounds substituted with a nitrogen-containing heterocyclic nucleus group (such as those described in U.S. Pat. Nos. 2,933,390 and 3,635,721), aromatic organic acid/formaldehyde condensates (such as those described in U.S. Pat. No. 3,743,510), cadmium salts and azaindene compounds. Combinations described in U.S. Pat. Nos. 3,615,613, 3,615,641, 3,617,295 and 3,635,721 are particularly useful.

It is preferred to use a sensitizing dye or supersensitizer selected from the group consisting of compounds of the following general formulae (VI), (VII), (VIII), (IX), (X), (XI) and (XII):

general formula (VI):

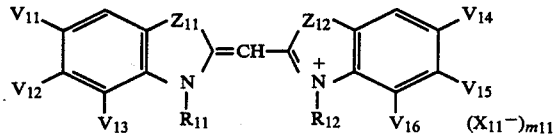

wherein $Z_{11}$ represents an oxygen atom, sulfur atom or selenium atom, $Z_{12}$ represents a sulfur atom or selenium atom, $R_{11}$ and $R_{12}$ each represent a substituted or unsubstituted alkyl or alkenyl group having 6 or less carbon atoms and one or $R_{11}$ and $R_{12}$ represents a sulfo-substituted alkyl group.

Preferably at least one of $R_{11}$ and $R_{12}$ represents a 3-sulfopropyl group, 2-hydroxy-3-sulfopropyl group, 3-sulfobutyl group or sulfoethyl group. The substituents include, for example, alkoxy groups having 4 or less carbon atoms, halogen atoms, hydroxy group, carbamoyl group, substituted or unsubstituted phenyl groups having 8 or less carbon atoms, carboxy group, sulfo group and alkoxycarbonyl groups having 5 or less carbon atoms. Examples of $R_{11}$ and $R_{12}$ include methyl, ethyl, propyl, allyl, pentyl, hexyl, methoxyethyl, ethoxyethyl, phenethyl, 2-p-triethyl, 2-p-sulfophenethyl, 2,2,2-trifluoroethyl, 2,2,3,3-tetra-fluoropropyl, carbamoylethyl, hydroxyethyl, 2-(2-hydroxyethyl)ethyl, carboxymethyl, carboxyethyl, ethoxycarbonylmethyl, 2-sulfoethyl, 2-chloro-3-sulfopropyl, 3-sulfopropyl, 2-hydroxy-3-sulfopropyl, 3-sulfobutyl and 4-sulfobutyl groups.

When $Z_{11}$ represents an oxygen atom, $V_{11}$ and $V_{13}$ each represent a hydrogen atom and $V_{12}$ represents a phenyl group, or alkyl or alkoxy group having 3 or less carbon atoms or phenyl group substituted with chlorine atom (particularly preferably $V_{12}$ is the phenyl group). $V_{11}$ and $V_{12}$ or $V_{12}$ and $V_{13}$ may be connected together to form a condensed benzene ring. It is more preferred that $V_{11}$ and $V_{13}$ each represent the hydrogen atom and $V_{12}$ represents the phenyl group.

When $Z_{11}$ represents a sulphur atom or selenium atom, $V_{11}$ represents an alkyl or alkoxy group having 4 or less carbon atoms or a hydrogen atom, $V_{12}$ represents an alkyl group having 5 or less carbon atoms, an alkoxy group having 4 or less carbon atoms, chlorine atom, hydrogen atom, substituted or unsubstituted phenyl group (such as tolyl, anisyl or phenyl group) or hydroxy group, and $V_{13}$ represents a hydrogen atom or $V_{11}$ and $V_{12}$ or $V_{12}$ and $V_{13}$ may form together a condensed benzene ring. Preferably $V_{11}$ and $V_{13}$ each represent a hydrogen atom and $V_{12}$ represents an alkoxy group having 4 or less carbon atoms, phenyl group or chlorine atom; or $V_{11}$ represents an alkoxy or alkyl group having 4 or less carbon atoms and $V_{12}$ represents a hydroxy group or alkyl group having 4 or less carbon atoms; or $V_{12}$ and $V_{13}$ form together a condensed benzene ring.

When $Z_{12}$ represents a selenium atom, the meanings of $V_{14}$ and $V_{11}$, $V_{15}$ and $V_{12}$, and $V_{16}$ and $V_{13}$ are the same. When $Z_{12}$ represents a sulfur atom and $Z_{11}$ represents a selenium atom, $V_{14}$ represents a hydrogen atom or alkoxy group having 4 or less carbon atoms, $V_{15}$ represents an alkoxy group having 4 or less carbon atoms, substituted or unsubstituted phenyl group such as tolyl or anisyl group or (preferably phenyl group), alkyl group having 4 or less carbon atoms, chlorine atom or hydroxy group, $V_{16}$ represents a hydrogen atom; or $V_{14}$ and $V_{15}$, or $V_{15}$ and $V_{16}$ together form a condensed benzene ring. Preferably $V_{14}$ and $V_{16}$ each represent a hydrogen atom and $V_{15}$ represents an alkoxy group having 4 or less carbon atoms, chlorine atom or phenyl group; or $V_{15}$ and $V_{16}$ together form a condensed benzene ring. When both $Z_{11}$ and $Z_{12}$ represent a sulfur atom, $V_{14}$ and $V_{16}$ each represent a hydrogen atom and $V_{15}$ represents an unsubstituted or substituted phenyl group (such as phenyl or tolyl group); or alternatively, $V_{14}$ represents a hydrogen atom and $V_{15}$ and $V_{16}$ can form together a condensed benzene ring. When $Z_{11}$ represents an oxygen atom and $Z_{12}$ represents a sulfur atom, $V_{14}$ and $V_{16}$ each represent a hydrogen atom and $V_{15}$ represents a chlorine atom, unsubstituted or substituted phenyl group or alkoxy group having 4 or less carbon atoms; or $V_{15}$ and $V_{16}$ can form together a condensed benzene ring; or preferably $V_{14}$ and $V_{16}$ each represent a hydrogen atom and $V_{15}$ represents a phenyl group; or $V_{15}$ and $V_{16}$ form together a condensed benzene ring.

$X_{11}$ represents a residual group of an acid anion, and $m_{11}$ represents 0 or 1 (when the compound is an inner salt, $m_{11}$ represents 1).

general formula (VII):

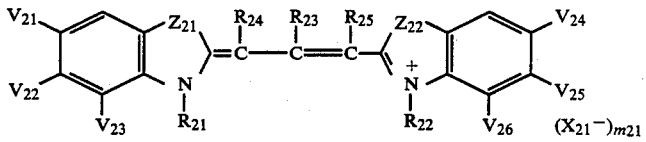

wherein $Z_{12}$ represents an oxygen, sulfur or selenium group or $>n\text{-}R_{26}$, $Z_{22}$ represents an oxygen atom or $>N\text{-}R_{27}$, $R_{21}$ and $R_{22}$ have the same meaning as that of $R_{11}$ or $R_{12}$ in the above general formula I, or $R_{21}$ can be bonded with $R_{24}$ to form a 5-or 6-membered carbon ring and $R_{22}$ can be bonded with $R_{25}$ to form the same ring.

$R_{23}$ represents a hydrogen atom when at least one of $Z_{21}$ and $Z_{22}$ represents $>N\text{-}R_{26}$, or $R_{23}$ represents an ethyl, propyl or butyl group (preferably ethyl group) in other cases, and $R_{24}$ and $R_{25}$ each represent a hydrogen atom.

$R_{26}$ and $R_{27}$ have the same meaning as that of $R_{21}$ and $R_{22}$ with the proviso that both of $R_{21}$ and $R_{26}$ cannot have a subsitutent having sulfo group at the same time or $R_{22}$ and $R_{27}$ cannot have a substituent having sulfo group at the same time.

$V_{21}$ represents a hydrogen atom when $Z_{21}$ represents an oxygen atom, $V_{21}$ represents a hydrogen atom or alkyl or alkoxy group having 5 or less carbon atoms when $Z_{21}$ represents a sulfur or selenium atom, or $V_{21}$ represents a hydrogen or chlorine atom when $Z_{21}$ represents $>N\text{-}R_{26}$.

$V_{22}$ represents a hydrogen atom, alkyl or alkoxy group having 5 or less carbon atoms, chlorine atom or unsubstituted or substituted phenyl group (such as tolyl, anisyl or phenyl group) or $V_{22}$ can form a condensed benzene ring together with $V_{21}$ or $V_{23}$ (preferably $V_{22}$ represents an alkoxy or phenyl group or $V_{22}$ forms a condensed benzene ring together with $V_{21}$ or $V_{23}$) when $Z_{21}$ represents an oxygen atom and $Z_{22}$ represents $>N\text{-}R_{27}$; $V_{22}$ represents an unsubstituted or substituted phenyl group (such as tolyl, anisyl or phenyl group; the phenyl group being preferred) or $V_{22}$ forms a condensed benzene ring together with $V_{21}$ or $V_{23}$ when $Z_{21}$ and $Z_{22}$ each represent an oxygen atom; $V_{22}$ represents a hydrogen atom, alkyl or alkoxycarbonyl group having 5 or less carbon atoms, alkoxy or acylamino group having 4 or less carbon atoms, chlorine atom or unsubstituted or substituted phenyl group (preferably an alkyl or alkoxy group having 4 or less carbon atoms, chlorine atom or phenyl group) when $Z_{21}$ represents a sulfur or selenium atom; or $V_{22}$ can form a condensed benzene ring together with $V_{23}$ when $Z_{21}$ represents a sulfur atom. Further, $V_{22}$ represents a chlorine atom, trifluoromethyl or cyano group or alkylsulfonyl group having 4 or less carbon atoms or alkoxycarbonyl group having 5 or less carbon atoms when $Z_{21}$ represents $>N\text{-}R_{26}$ (preferably $V_{21}$ represents a chlorine atom and $V_{22}$ represents a chlorine atom or trifluoromethyl or cyano group when $Z_{21}$ represents $>N\text{-}R_{26}$).

$V_{24}$ represents a hydrogen atom when $Z_{22}$ represents an oxygen atom, or $V_{24}$ represents a hydrogen or chlorine atom when $Z_{22}$ represents $>N\text{-}R_{27}$.

$V_{25}$ represents an alkoxy group having 4 or less carbon atoms, chlorine atom or unsubstituted or substituted phenyl group (such as anisyl, tolyl or phenyl group) or $V_{25}$ can form a condensed benzene ring together with $V_{24}$ or $V_{26}$ when $Z_{22}$ represents an oxygen atom; preferably $V_{25}$ represents an alkoxy group having 4 or less carbon atoms or phenyl group or $V_{25}$ can form a condensed benzene ring together with $V_{24}$ or $V_{26}$ when $Z_{21}$ represents $>N\text{-}R_{26}$; and more preferably $V_{25}$ represents a phenyl group or it forms a condensed benzene ring together with $V_{25}$ or $V_{26}$ when $Z_{21}$ represents an oxygen, sulfur or selenium atom. Further, $V_{25}$ represents a chlorine atom, trifluoromethyl or cyano group, alkylsulfonyl group having 4 or less carbon atoms or carboxyalkyl group having 5 or less carbon atoms when $Z_{22}$ represents $>N\text{-}R_{27}$. It is most preferred that $V_{24}$ represents a chlorine atom and $V_{25}$ represents a chlorine atom or trifluoromethyl or cyano group.

$V_{26}$ represents a hydrogen atom.

$X_{21}^-$ represents a residual group of an acid anion.

$m_{21}$ represents 0 or 1 (when the compound is an inner salt, $m_{21}$ represents 0).

general formula (VIII)

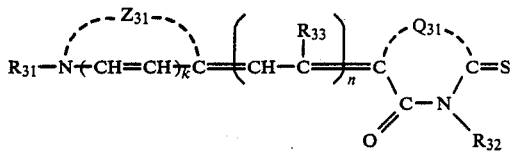

wherein $Z_{31}$ represents an atomic group forming a thiazoline, thiazole, benzothiazole, naphthothiazole, selenasoline, selenasole, benzoselenasole, naphthoselenasole, benzimidazole, naphthoimidazole, oxazole, benzoxazole, naphthoxazole or pyridine nucleus. These heterocyclic nuclei can be substituted. In case of forming benzimidazole nucleus or naphthoimidazole nucleus, substituents of nitrogen at position 1 other than $R_{31}$ are the same as those described above as $R_{26}$ or $R_{27}$ in the general formula II. The substituents of the condensed benzene ring of the benzimidazole include chlorine atom, cyano group, alkoxycarbonyl groups having 5 or less carbon atoms, alkylsulfonyl groups having 4 or less carbon atoms and trifluoromethyl group. Particularly preferred is the compound having a chlorine atom at position 5, and cyano group, chlorine atom or trifluoromethyl group at position 6. Examples of the substituents of the heterocyclic nuclei other than the benzimidazole, selenazoline and thiazoline nuclei include unsubstituted or substituted alkyl groups having 8 or less carbon atoms in total (the substituents being, for example, hydroxy group, chlorine or fluorine atom or alkoxy, carboxy, alkoxycarbonyl, phenyl or substituted phenyl group), hydroxy group, alkoxycarbonyl groups having 5 or less carbon atoms, halogen atoms, carboxy, furyl, thienyl, pyridyl, phenyl group and substituted phenyl groups (such as tolyl, anisyl and chlorophenyl groups). Examples of the substituents of the selenasoline or thiazoline nucleus include alkyl groups having 6 or less carbon atoms, hydroxyalkyl groups having 5 or less carbon atoms and alkoxycarbonylalkyl groups having 5 or less carbon atoms.

$R_{31}$ has the same meaning as $R_{11}$ or $R_{12}$ in the general formula I.

$R_{32}$ has the same meaning as $R_{11}$ or $R_{12}$ in the general formula I or it represents a hydrogen atom, furfuryl group or an unsubstituted or substituted monocyclic aryl group (such as phenyl, tolyl, anisyl, carboxyphenyl, hydroxyphenyl, chlorophenyl, sulfophenyl, pyridyl, 5-methyl-2-pyridyl, 5-chloro-2-pyridyl, thienyl or furyl group). At least one of $R_{31}$ and $R_{32}$ represents a substituent having a sulfo or carboxy group and the other represents a sulfo-free group $R_{33}$ represents a hydrogen atom, alkyl group having 5 or less carbon atoms, or phenethyl, phenyl or 2-carboxyphenyl group. Among them, hydrogen atom or methyl or ethyl group is preferred.

$Q_{31}$ represents an oxygen, sulfur or selenium atom or $>N\text{-}R_{34}$. Preferably $Q_{31}$ represents a sulfur or selenium atom or $>N\text{-}R_{34}$ when $Z_{31}$ represents an atomic group forming thiazoline, selenazoline or oxazole nucleus.

$R_{34}$ represents a pyridyl or phenyl group, substituted phenyl group (such as tolyl or anisyl group) or aliphatic hydrocarbon group having 8 or less carbon atoms in total which may have (1) an oxygen, sulfur or nitrogen atom in the carbon chain and (2) a substituent such as hydroxy group, halogen atom or alkylaminocarbonyl, alkoxycarbonyl or phenyl group. Preferably $R_{34}$ represents a hydrogen atom, phenyl or pyridyl group or alkyl group which can contain (1) an oxygen atom in the carbon chain and (2) hydroxy group.

k represents 0 or 1, and n represents 0 or 1.

$Q_{31}$ represents an oxygen atom when n represents 1 and $Z_{31}$ represents a pyridyl-forming atomic group.

Examples of the compounds of the general formulae VI, VII and VIII are as follows:

VI-1

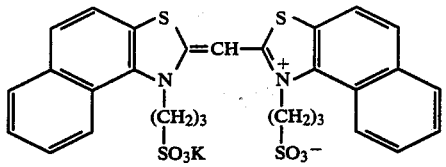

VI-2

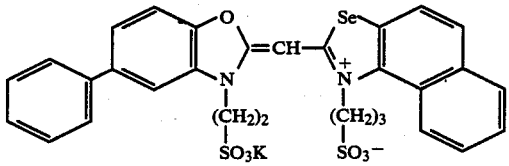

VI-3

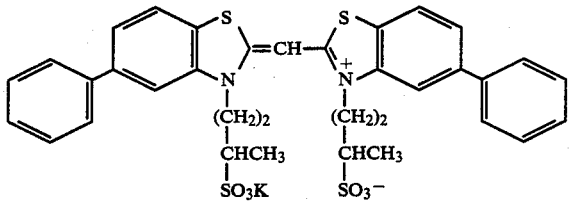

VI-4

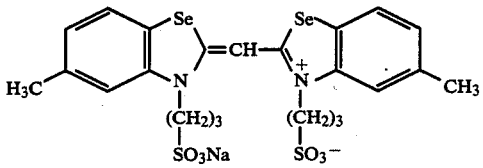

VI-5

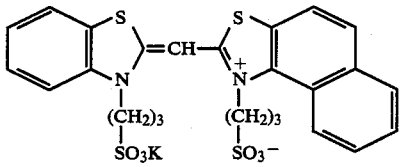

VI-6

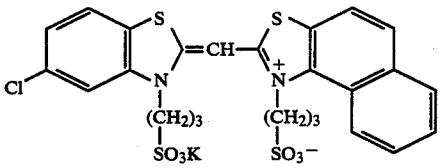

VI-7

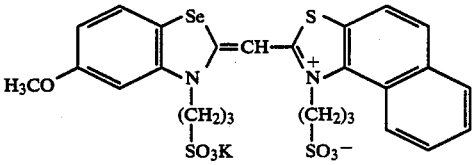

VI-8

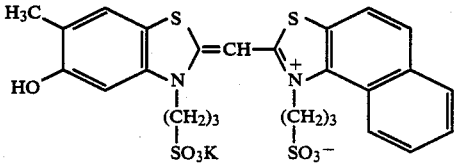

-continued
VI-9
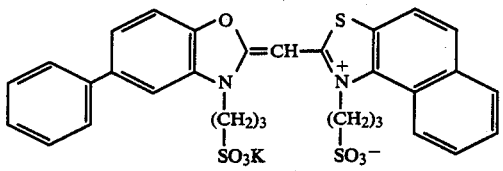
VI-10
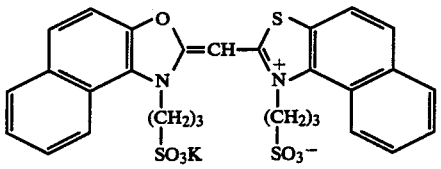
VI-11
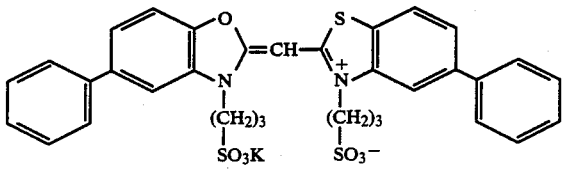
VI-12
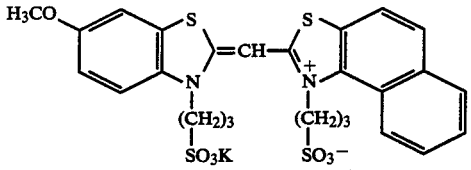
VI-13
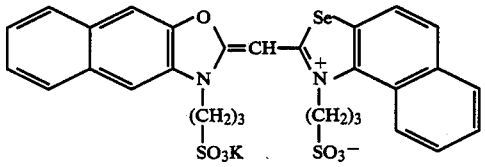
VI-14
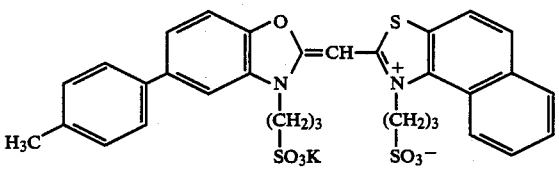
VI-15
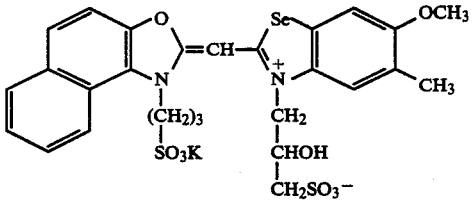
VI-16
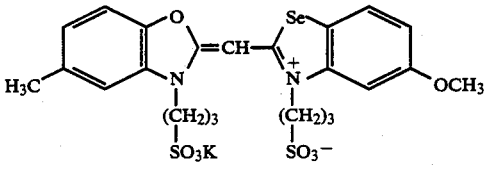

-continued
VII-1
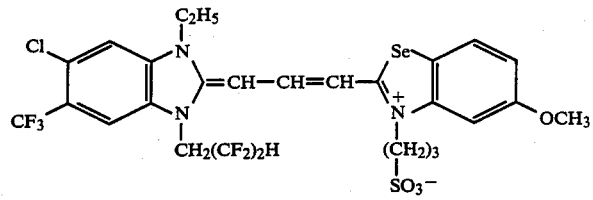
VII-2
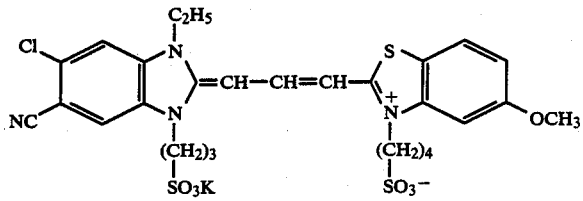
VII-3
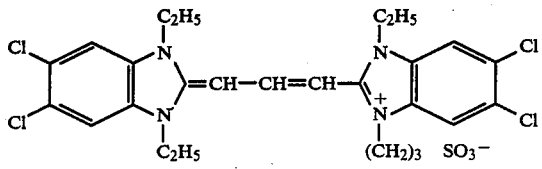
VII-4
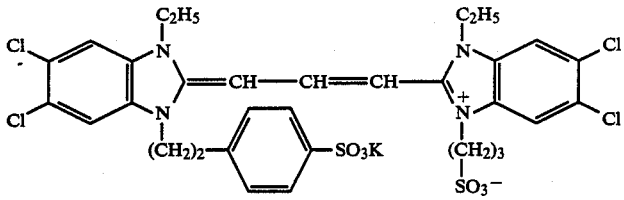
VII-5
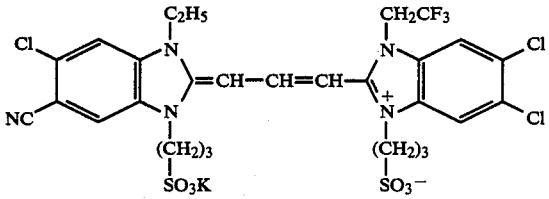
VII-6
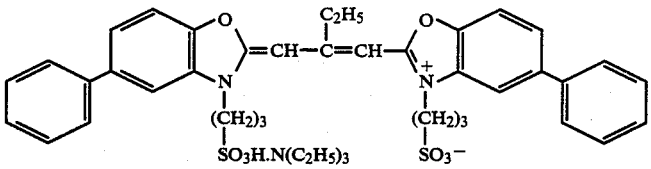
VII-7
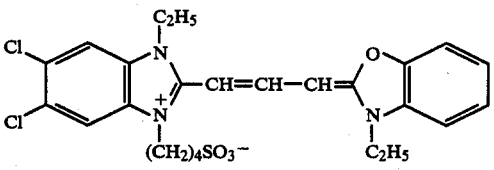
VII-8
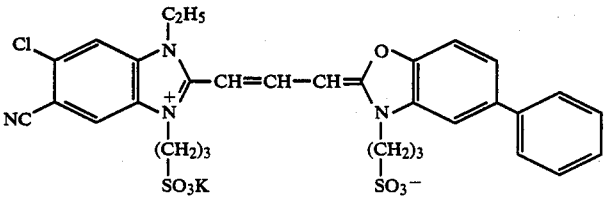

-continued
VII-9
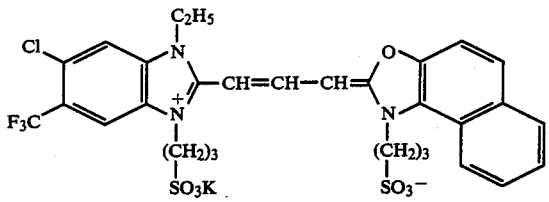
VII-10
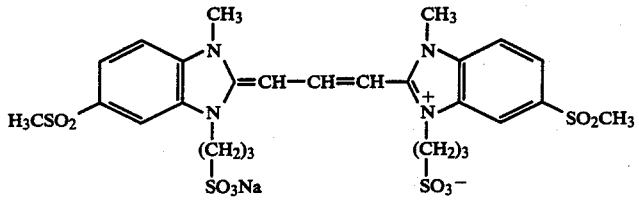
VII-11
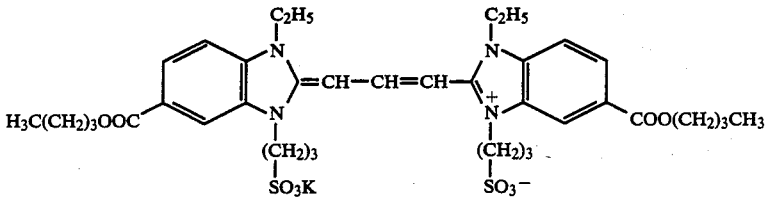
VII-12
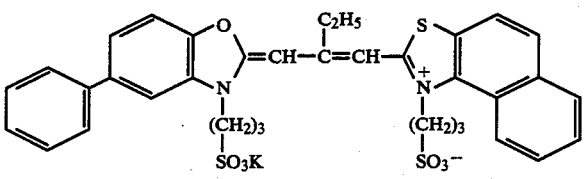
VII-13
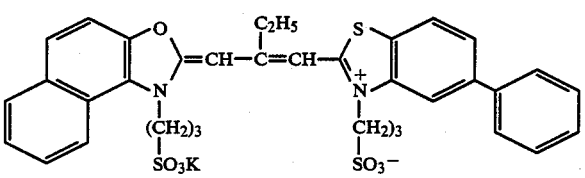
VII-14
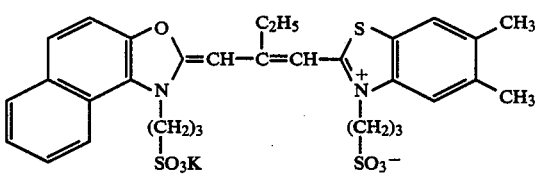
VII-15
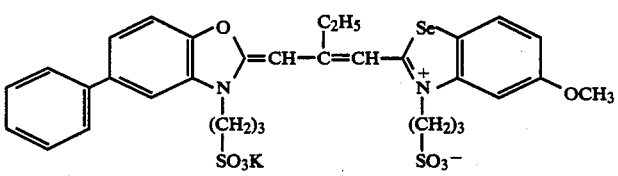
VII-16
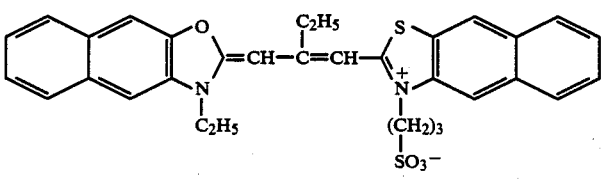

-continued
VII-17
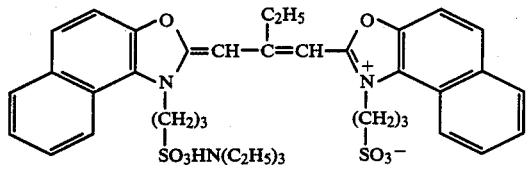
VII-18
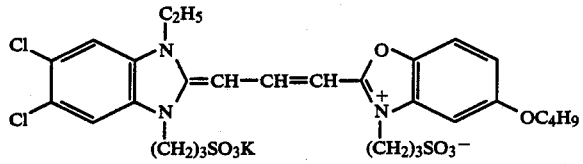
VII-19
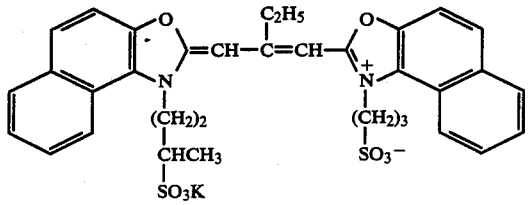
VII-20
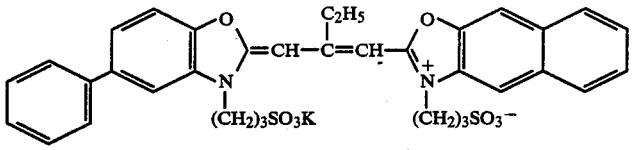
VII-21
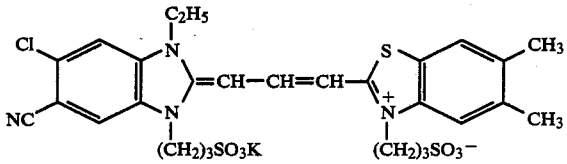
VII-22
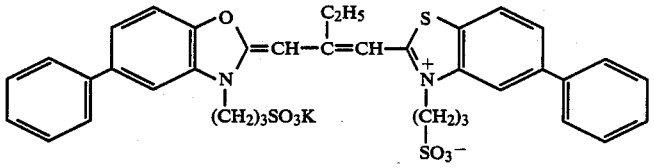
VII-23
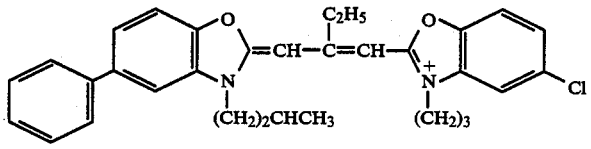
VIII-1
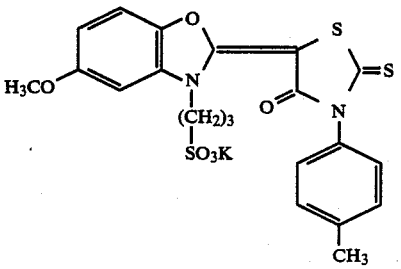

-continued
VIII-2
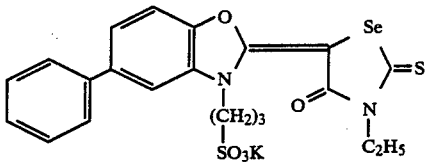
VIII-3
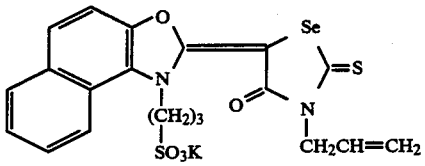
VIII-4
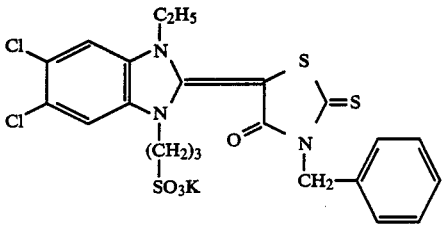
VIII-5
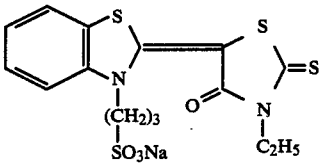
VIII-6
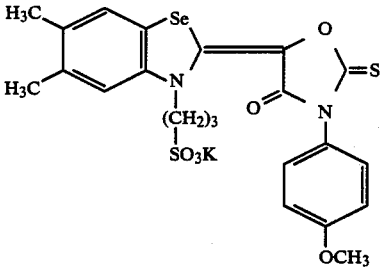
VIII-7
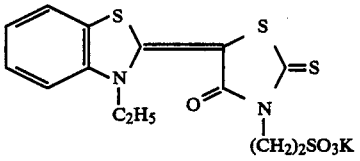
VIII-8
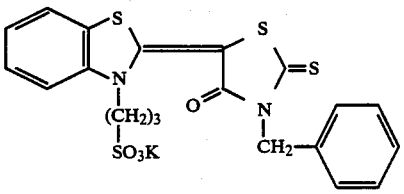

-continued
VIII-9
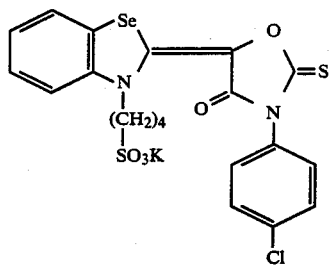
VIII-10
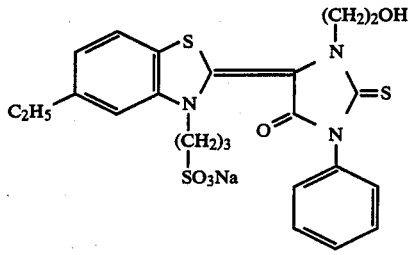
VIII-11
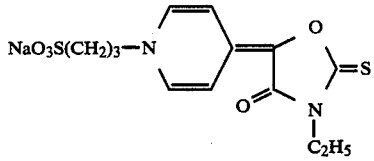
VIII-12
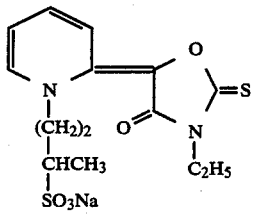
VIII-13
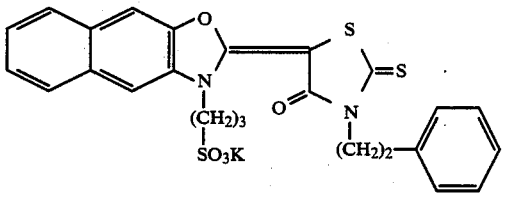
VIII-14
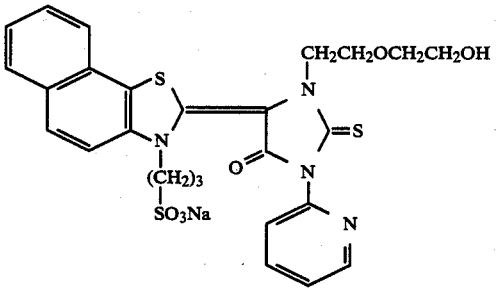
VIII-15
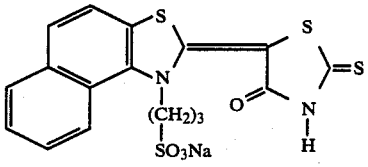

-continued
VIII-16
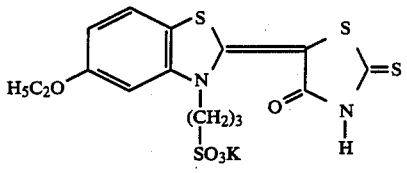
VIII-17
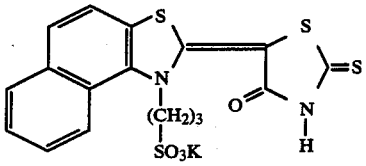
VIII-18
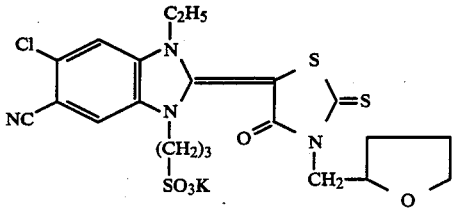
VIII-19
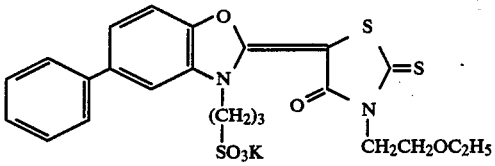
VIII-20
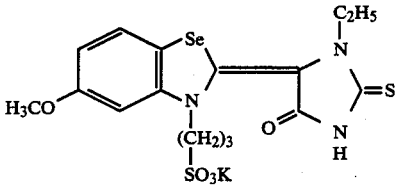
VIII-21
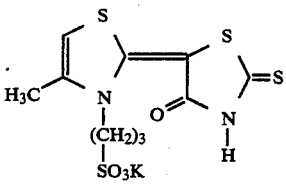
VIII-22
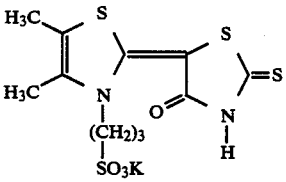
VIII-23
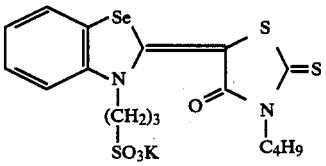

-continued
VIII-24
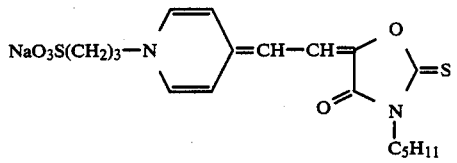
VIII-25
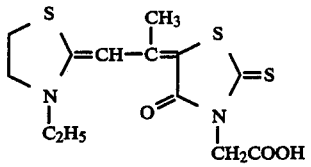
VIII-26
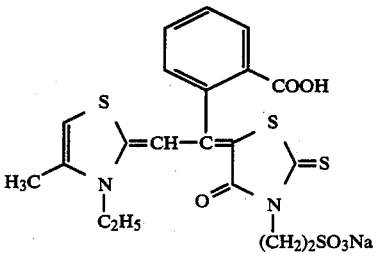
VIII-27
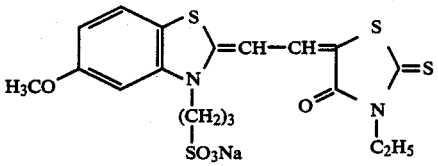
VIII-28
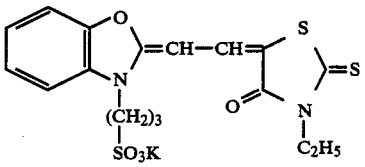
VIII-29
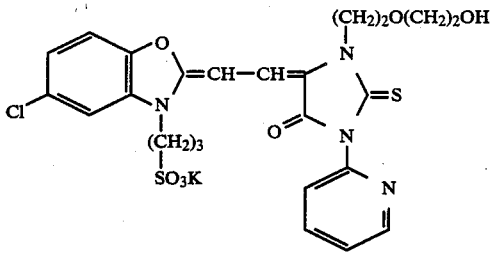
VIII-30
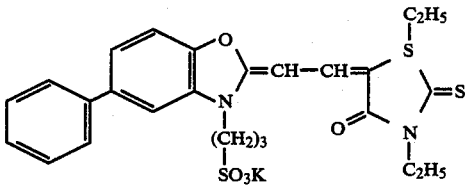
VIII-31
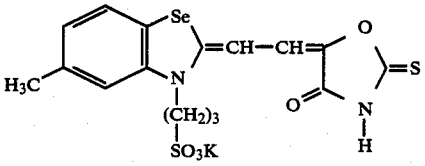

-continued
VIII-32
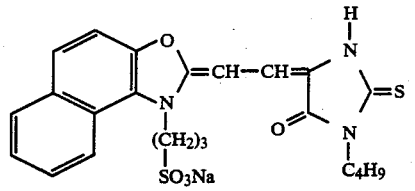
VIII-33
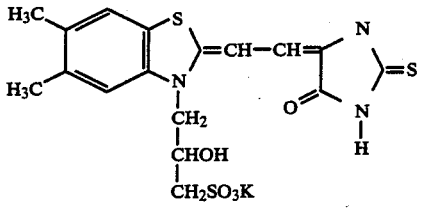
VIII-34
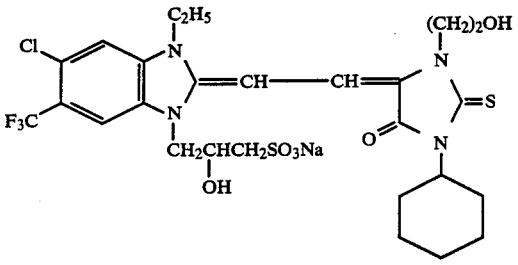
VIII-35
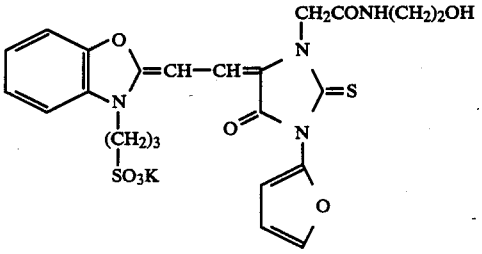
VIII-36
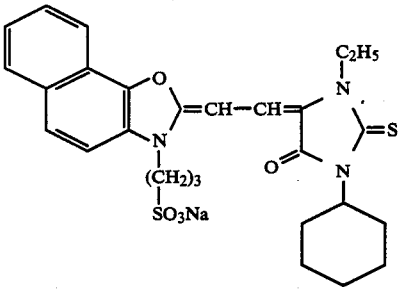
VIII-37
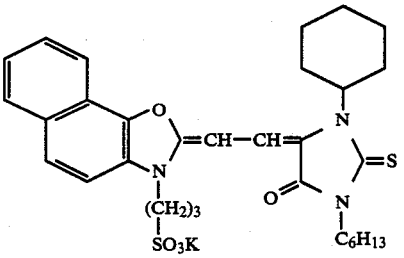
general formula (IX):

-continued

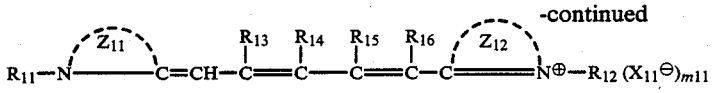

In the above formulae, $Z_{11}$ represents and atomic group forming benzoxazole, naphthoxazole, benzothiazole, naphthothiazole, dihydronaphthothiazole, benzoselenazole, naphthoselenazole or dihydronaphthoselenazole, and $Z_{12}$ represents an atomic group forming benzothiazole, naphthothiazole, dihydronaphthothiazole, benzoselenazole, naphthoselenazole or dihydronaphthoselenazole.

The nitrogen-containing heterocyclic nucleus represented by $Z_{11}$ or $Z_{12}$ can have one or more substituents. Examples of the preferred substituents include lower alkyl groups (more preferably alkyl groups having 6 or less carbon atoms), lower alkoxy groups (more preferably alkoxy groups having 6 or less carbon atoms), chlorine atom, lower alkoxycarbonyl groups (more preferably alkoxycarbonyl groups having 5 or less carbon atoms), unsubstituted or substituted phenyl groups (such as phenyl, tolyl, anisyl and chlorophenyl groups) and hydroxy group.

Examples of the compounds having the nitrogen-containing heterocyclic nucleus represented by $Z_{11}$ or $Z_{12}$ include 5-hydroxybenzoxazole, 5-methoxyoxazole, 5-ethoxybenzoxazole, 5-phenylbenzoxazole, 5,6-dimethylbenzoxazole, 5-methyl-6-methoxybenzoxazole, 6-ethoxy-5-hydrobenzoxazole, naphtho[1,2-d]oxazole, naphtho[2,3-d]oxazole, naphtho[2,1-d]oxazole, 5-methylbenzothiazole, 5-methoxybenzothiazole, 5-ethylbenzothiazole, 5-p-tolylbenzothiazole, 6-methylbenzothiazole, 6-ethylbenzothiazole, 6-butylbenzothiazole, 6-methoxybenzothiazole, 6-butoxybenzothiazole, 5,6-dimethylbenzothiazole, 5,6-dimethoxybenzothiazole, 5-hydroxy-6-methylbenzothiazole, 5-ethoxycarbonylbenzothiazole, 5-chlorobenzothiazole, 5-chloro-6-methylbenzothiazole, naphtho[1,2-d]thiazole, naphtho[2,1-d]thiazole, 5-methylnaphtho[2,1-d]thiazole, 8,9-dihydronaphtho[1,2-d]thiazole, 8-methoxynaphtho[1,2-d]thiazole, benzothiazole, benzoselenasole, 5-methylbenzoselenasole, 6-methylbenzoselenasole, 5-methoxybenzoselenasole, 6-methoxybenzoselenasole, 5,6-dimethylbenzoselenasole, 5-ethoxy-6-methylbenzoselenazole, 5-hydroxy-6-methylbenzoselenazole, naphtho[1,2-d]selenazole and naphtho[2,1-d]selenazole.

$R_{11}$ and $R_{12}$ may be the same or different and they each represent an unsubstituted or substituted alkyl or alkenyl group having 10 or less carbon atoms. At least one of $R_{11}$ and $R_{12}$ has a sulfo group. Examples of the substituents of the alkyl and alkenyl groups include the above-mentioned sulfo group, alkoxy groups having 6 or less carbon atoms, halogen atoms, hydroxy group, unsubstituted or substituted aryl group having 8 or less carbon atoms (such as phenyl, furyl, thienyl, tolyl, p-butylphenyl, xylyl, anisyl, sulfophenyl, hydroxyphenyl, carboxyphenyl and chlorophenyl groups), unsubstituted or substituted phenoxy groups having 8 or less carbon atoms (the substitutents being, for example, a fluorine or chlorine atom or sulfo, hydroxy, carboxy, alkoxycarbonyl, alkyl or alkoxy groups), acyl groups having 8 or less carbon atoms (such as phenylsulfonyl, tosyl, methylsulfonyl, benzoyl, acetyl and propionyl groups), alkoxycarbonyl groups having 6 or less carbon atoms and carboxy group.

$R_{13}$ and $R_{16}$ each represent a hydrogen atom or $R_{13}$ can form a 5- or 6-membered ring together with $R_{15}$.

$R_{14}$ represents a hydrogen atom, or when $R_{13}$ and $R_{15}$ each represent a hydrogen atom, $R_{14}$ represents an alkyl group having 4 or less carbon atoms or a phenylalkyl group having 10 or less carbon atoms.

Preferably, $R_{14}$ represents a hydrogen atom and $R_{13}$ and $R_{15}$ together form a 5- or 6-membered ring or, alternatively, $R_{13}$ and $R_{15}$ each represent a hydrogen atom and $R_{14}$ represents a benzyl group.

$R_{16}$ represents a hydrogen atom or it can form a 5- or 6-membered carbon ring together with $R_{12}$.

Among the nitrogen-containing heterocyclic nucleusforming atomic groups represented by $Z_{11}$, preferred are naphthoxazoles, benzothiazoles having at least one electrondonating group having a negative Hammett's $\sigma p$ value, dihydronaphthothiazoles, naphthothiazoles and benzoselenazoles.

$X_{11}^{\ominus}$ represents a residual group of an acid anion.

$m_{11}$ represents 0 or 1 (when the compound is an inner salt, $m_{11}$ represents 0).

general formula X.:

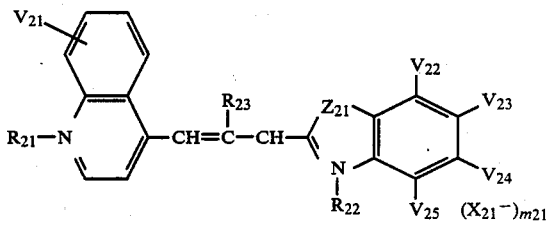

wherein $Z_{21}$ represents a sulfur atom or selenium atom.

$R_{21}$ and $R_{22}$ have the same meaning as that of $R_{11}$ or $R_{12}$ in the general formula I and at least one of them represents a substituent having a sulfo or carboxy group.

$R_{23}$ represents a hydrogen atom or lower alkyl group having 4 or less carbon atoms.

$V_{21}$ represents a hydrogen atom, alkyl or alkoxy group having 6 or less carbon atoms, fluorine or chlorine atom or hydroxy group.

$V_{22}$ and $V_{25}$ each represent a hydrogen atom.

$V_{23}$ represents a hydrogen atom, lower alkyl group (having preferably 6 or less carbon atoms), lower alkoxy group (having preferably 6 or less carbon atoms) or hydroxy group.

$V_{24}$ represents a hydrogen atom lower alkyl group (having preferably 6 or less carbon atoms), lower alkoxy group (having preferably 6 or less carbon atoms), chlorine atom, lower alkoxycarbonyl group, unsubstituted or substituted phenyl group (such as phenyl, tolyl or anisyl group) or hydroxy group.

$V_{22}$ and $V_{23}$; $V_{23}$ and $V_{24}$; or $V_{24}$ and $V_{25}$ can form together a condensed benzene ring which may have a substituent. Examples of the substituents include chlorine atom, lower alkyl groups (having preferably 4 or less carbon atoms) and lower alkoxy groups (having preferably 4 or less carbon atoms).

Among the nitrogen-containing heterocyclic nuclei containing $Z_{21}$, the most preferred are naphtho[1,2-d]thiazole, naphtho[2,1-d]thiazole, naphtho[1,2-d]selenazole, naphtho[2,1-d]selenazole and benzoselenazoles having at least one electron-donating group having a negative Hammett's $\sigma p$ value.

$X_{21}\ominus$ represents a residual group of an acid anion.

$m_{21}$ represents 0 or 1 (when the compound is an inner salt, $m_{21}$ represents 0).

[general formula XI]:

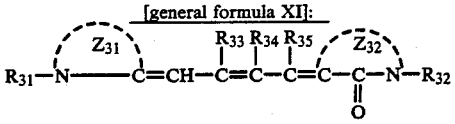

wherein $Z_{31}$ has the same meaning as that of $Z_{12}$ in the general formula I or it represents a naphthoxazole. The nitrogen-containing heterocyclic nucleus formed by $Z_{31}$ may have a substituent which is selected from the above-mentioned substituents of the nitrogen-containing heterocyclic nucleus represented by $Z_{11}$ or $Z_{12}$ in the general formula I.

$Z_{32}$ represents a sulfur or selenium atom or N-$R_{36}$.

$R_{36}$ represents a hydrogen atom, pyridyl or phenyl group, substituted phenyl group (such as tolyl, anisyl or hydroxyphenyl group) or an aliphatic hydrocarbon group having 8 or less carbon atoms which may have (1) an oxygen, sulfur or nitrogen atom in the carbon chain and (2) a substituent such as hydroxy group, halogen atom or alkylaminocarbonyl, alkoxycarbonyl or phenyl group. Preferably $R_{36}$ represents a hydrogen atom, phenyl or pyridyl group or alkyl group which can contain (1) an oxygen atom in the carbon chain and (2) hydroxy group.

$R_{31}$ has the same meaning as that of $R_{11}$ or $R_{12}$ in the general formula I.

$R_{32}$ has the same meaning as that of $R_{11}$ or $R_{12}$ in the general formula I or it represents a hydrogen atom, furfuryl group, unsubstituted or substituted monocyclic aryl group (such as phenyl, tolyl, anisyl, carboxyphenyl, hydroxyphenyl, chlorophenyl, sulfophenyl, pyridyl, 5-methyl-2-pyridyl, 5-chloro-2-pyridyl, furyl or thienyl group).

$R_{33}$ and $R_{35}$ each represent a hydrogen atom or they form together a 5- or 6-membered ring.

$R_{34}$ has the same meaning as that of $R_{14}$ in the general formula VI.

At least one of $R_{31}$ and $R_{32}$ represents a sulfo group-free group and the other represents a group containing a sulfo or carboxy group.

IX-1

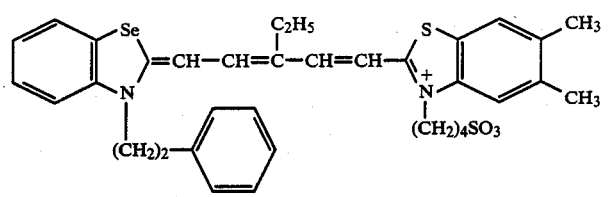

IX-2

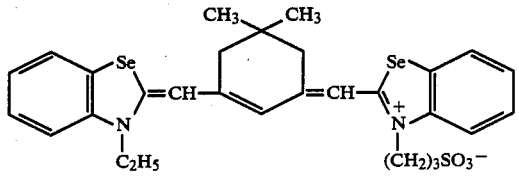

IX-3

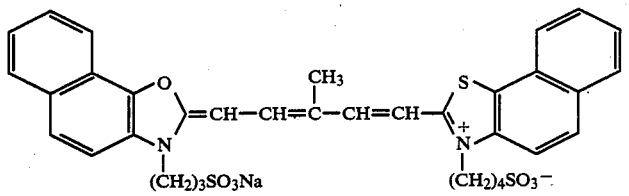

IX-4

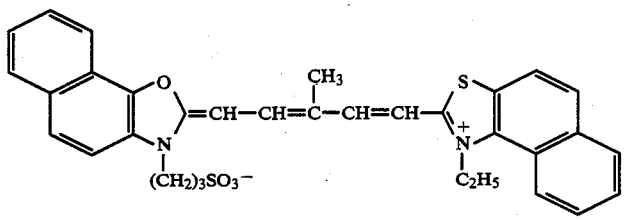

IX-5

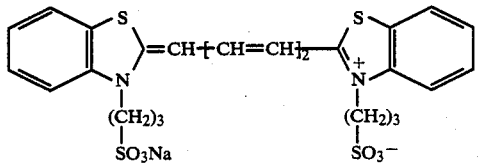

-continued
IX-6
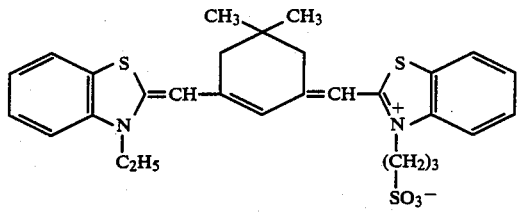
IX-7
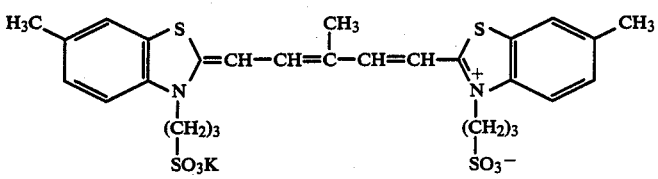
IX-8
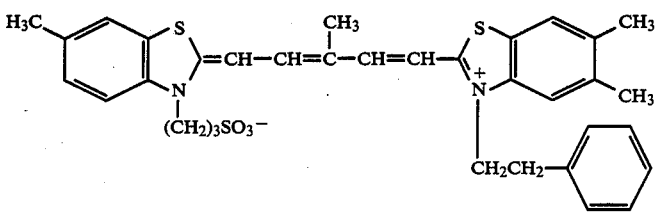
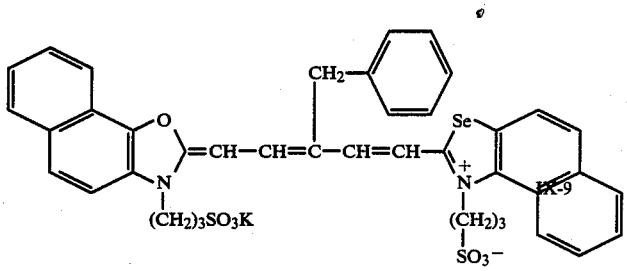
IX-9
IX-10
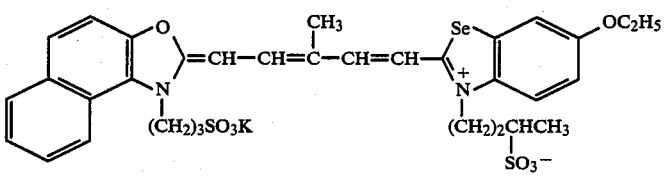
IX-11
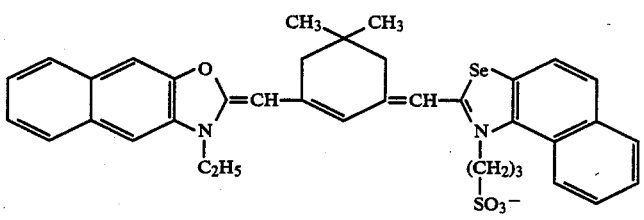
IX-12
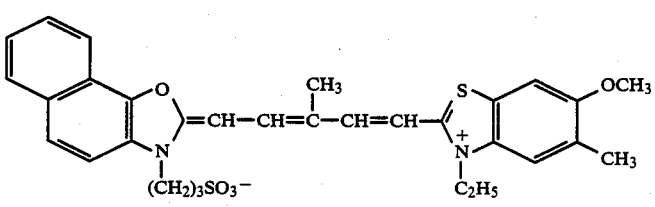

-continued
IX-13
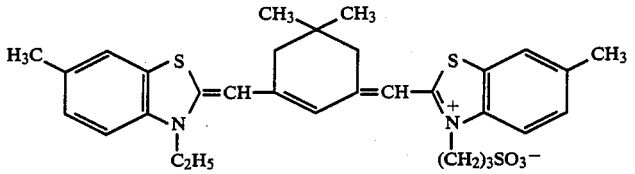
IX-14
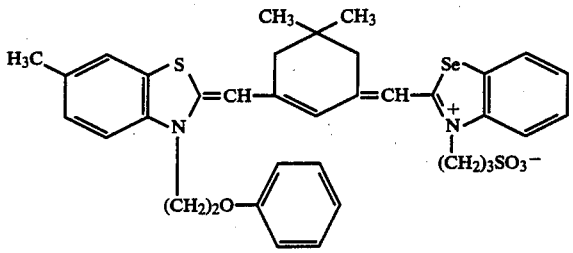
IX-15
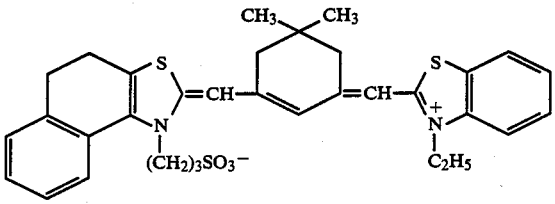
IX-16
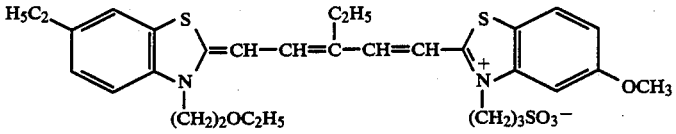
X-1
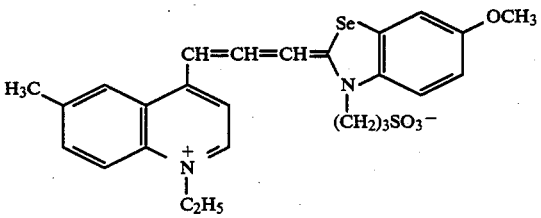
X-2
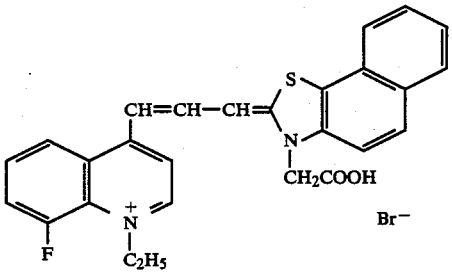
X-3
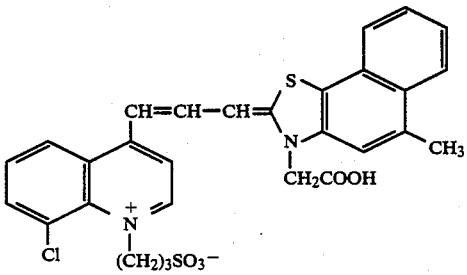

-continued
X-4
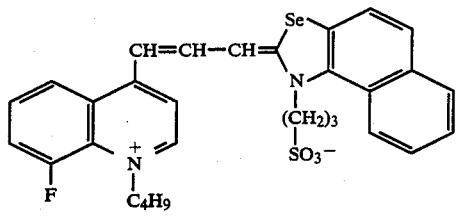
X-5
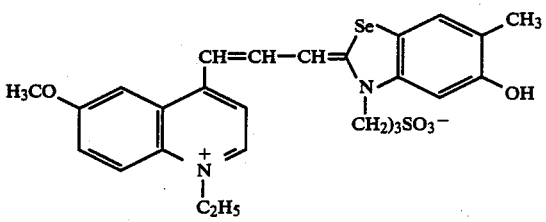
XI-1
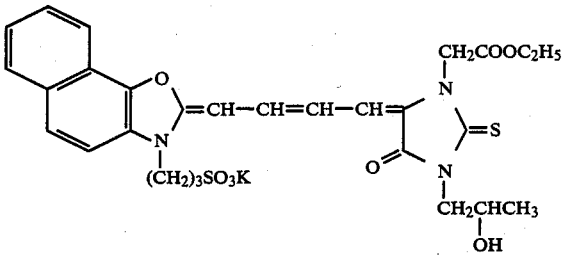
XI-2
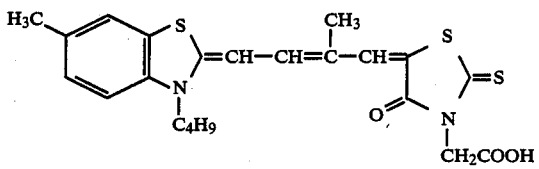
XI-3
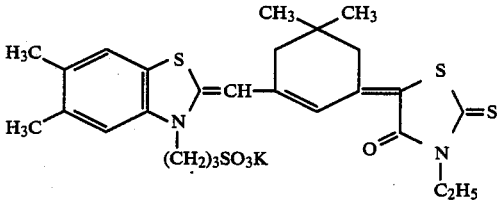
XI-4
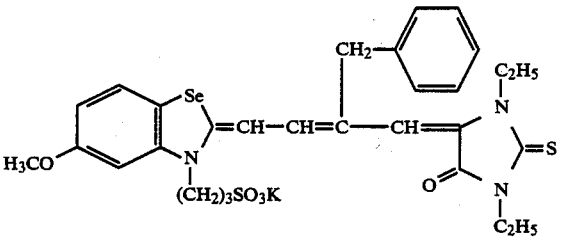
XI-5
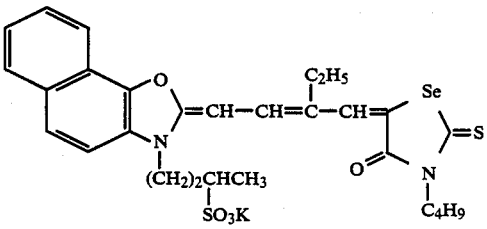

-continued
XI-6
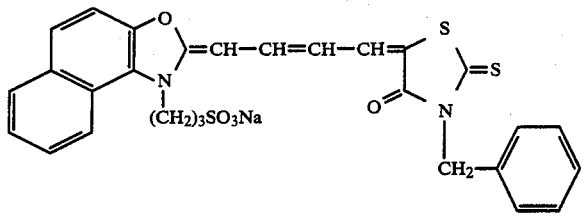
XI-7
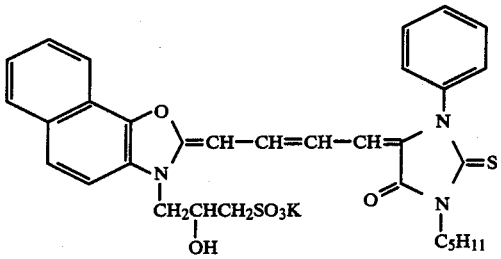
XI-8
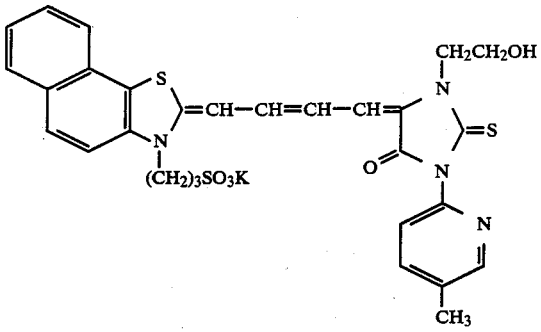
XI-9
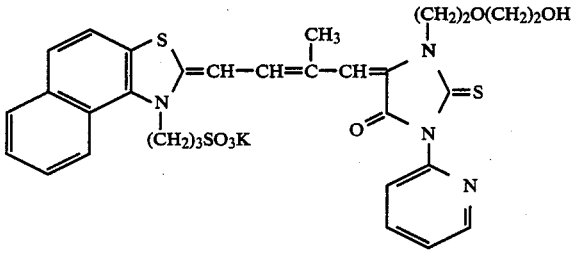
XI-10
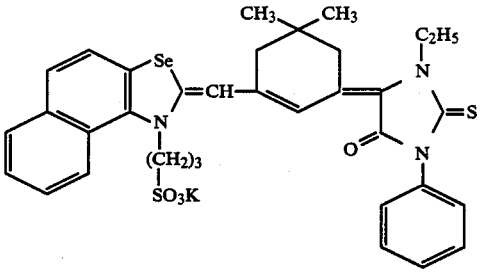
XI-11
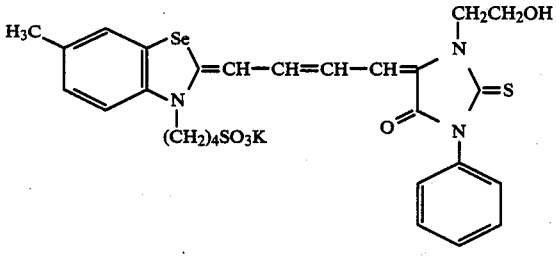

-continued

XI-12

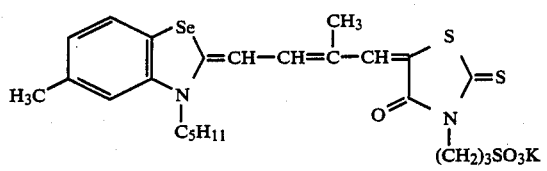

XI-13

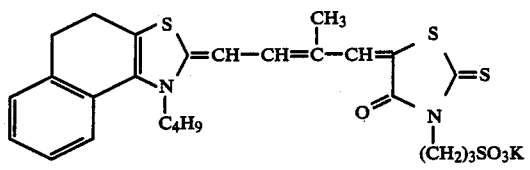

XI-14

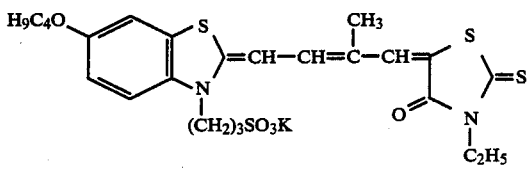

XI-15

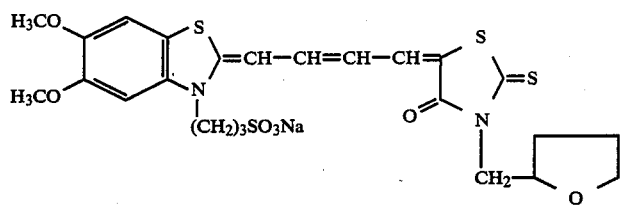

XI-16

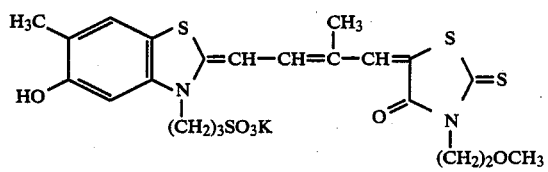

[general formula XII]

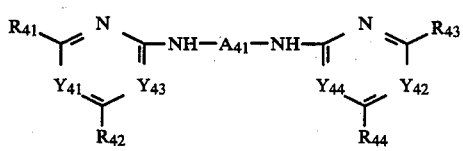

wherein $Y_{41}$, $Y_{42}$, $Y_{43}$ and $Y_{44}$ may be the same or different and each represent =CH— or =N—, and at least one of $Y_{41}$ and $Y_{43}$ and at least one of $Y_{42}$ and $Y_{44}$ represent =N—.

$R_{41}$, $R_{42}$, $R_{43}$ and $R_{44}$ may be the same or different and each represent a hydrogen atom, hydroxy group, lower alkoxy group (having preferably 10 or less carbon atoms), aryloxy group (such as phenoxy, tolyloxy, sulfophenoxy, β-naphtoxy, α-naphthoxy or 2,4-dimethylphenoxy group), halogen atom (such as chlorine or bromine atom), heterocyclic nucleus (such as morpholinyl or piperidine group), alkylthio group (such as methylthio or ethylthio group), heterocyclylthio group (such as benzothiazylthio group), arylthio group (such as phenylthio or tolylthio group), amino, alkylamino or substituted alkylamino group (such as methylamino, ethylamino, propylamino, dimethylamino, diethylamino, dodecylamino, cyclohexylamino, β-hydroxyethylamino, di-β-hydroxyethylamino or β-sulfoethylamino group), arylamino or substituted arylamino group (such as anilino, o-sulfoanilino, m-sulfoanilino, p-sulfoanilino, o-anizylamino, m-anisylamino, p-anisylamino, o-methylanilino, p-tert-amylanilino, o-carboxyanilino, m-carboxyanilino, p-carboxyanilino, hydroxyanilino, naphthylamino, sulfonaphthylamino, heterocyclylamino (such as 2-benzothiazolamino or 2-pyridylamino), aryl (such as phenyl) or mercapto group.

$A_{41}$ represents a group containing an arylene group. Examples of the groups $A_{41}$ include those of the following formulae:

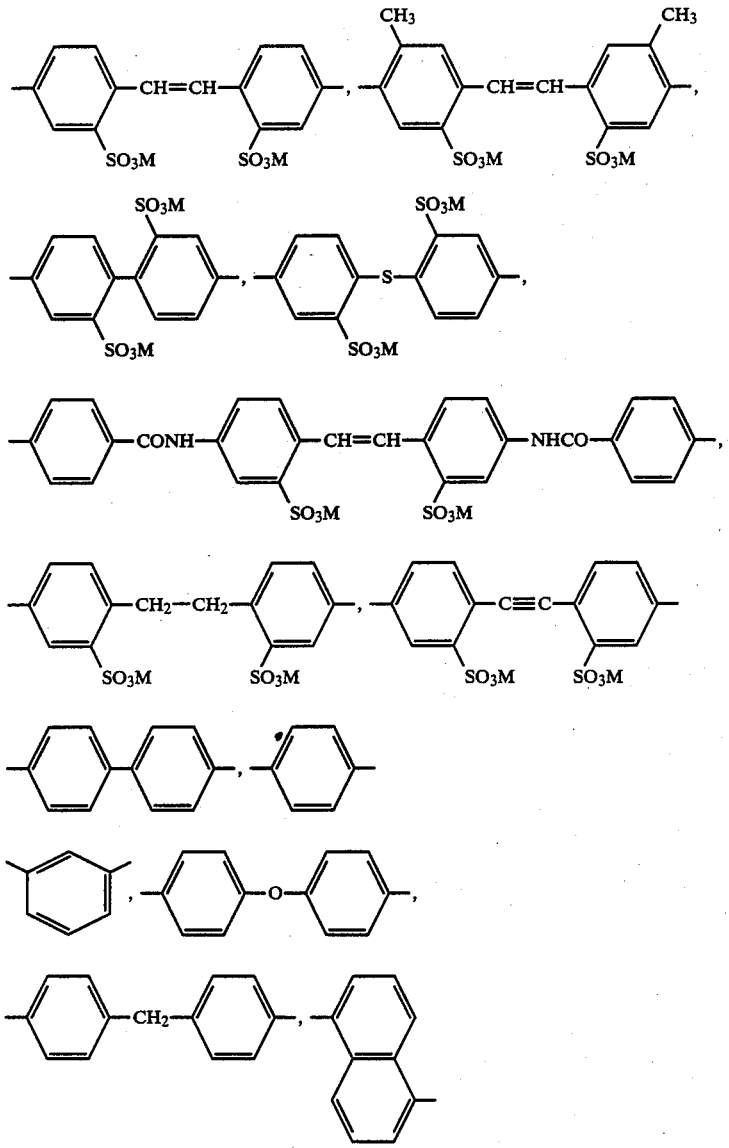
wherein M represents a hydrogen atom or a cation which contributes to the water solubility.
At least one of $R_{41}$, $R_{42}$, $R_{43}$, $R_{44}$ and $A_{41}$ in the above general formula IV contains a sulfo group.
The most preferred compounds of the general formula IV are stilbene derivatives.

XII-1
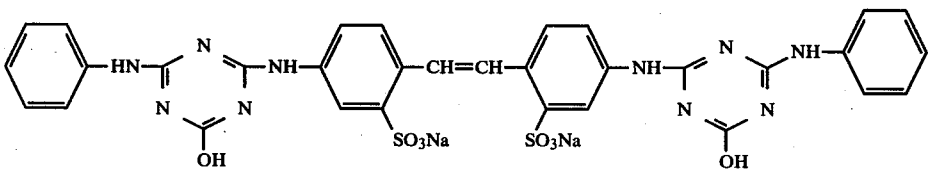
XII-2
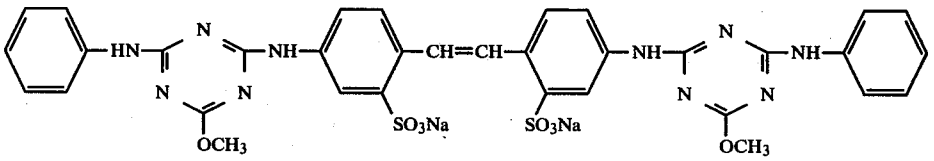
XII-3
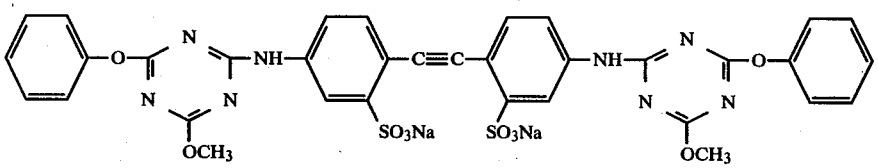
XII-4
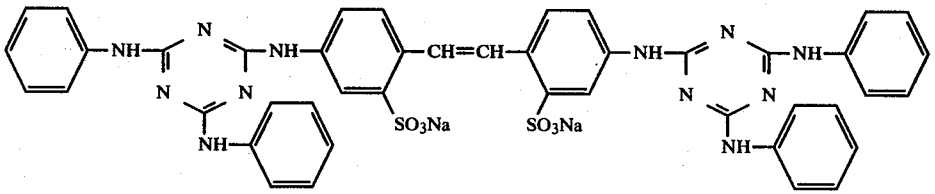
XII-5
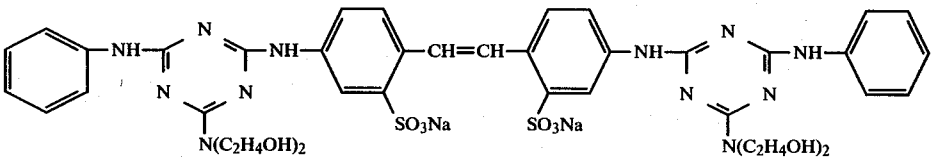

-continued
XII-6
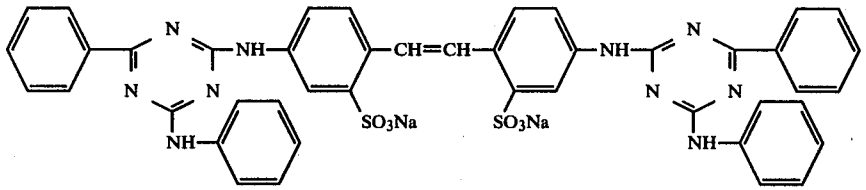
XII-7
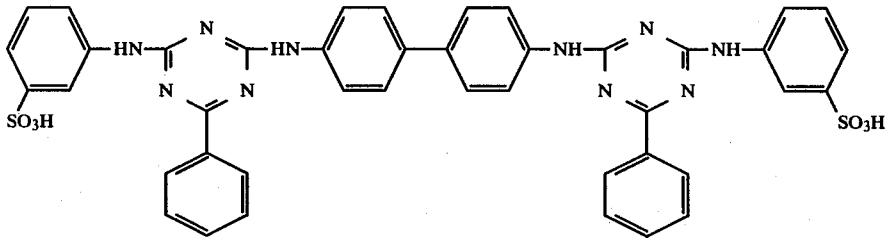
XII-8
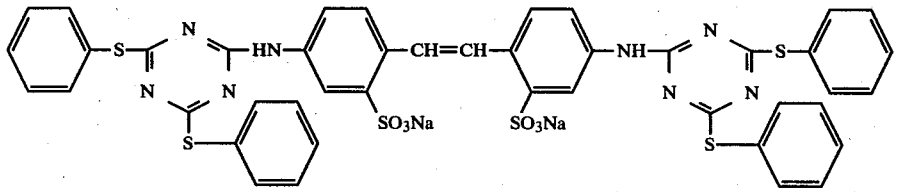
XII-9
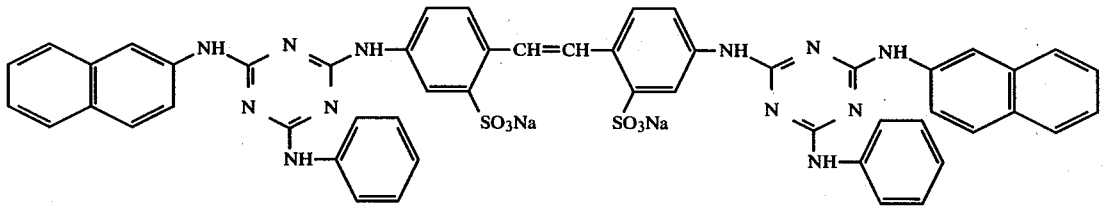
XII-10
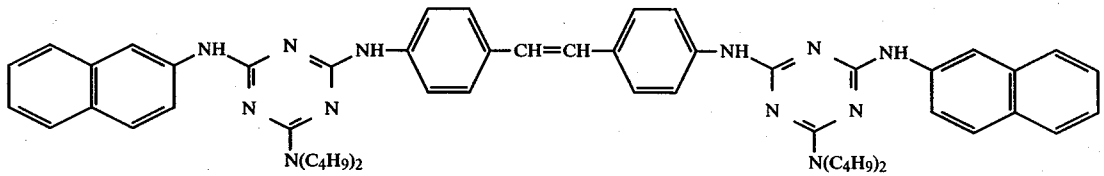

-continued
XII-11
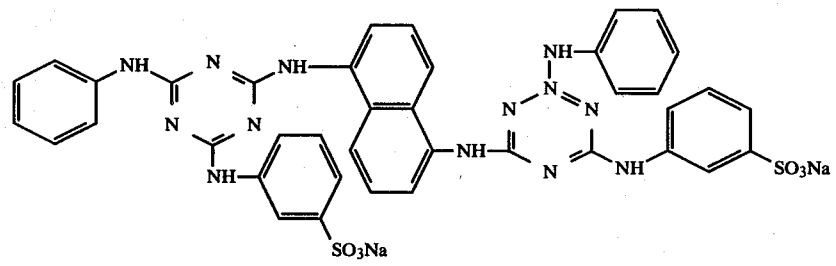
XII-12
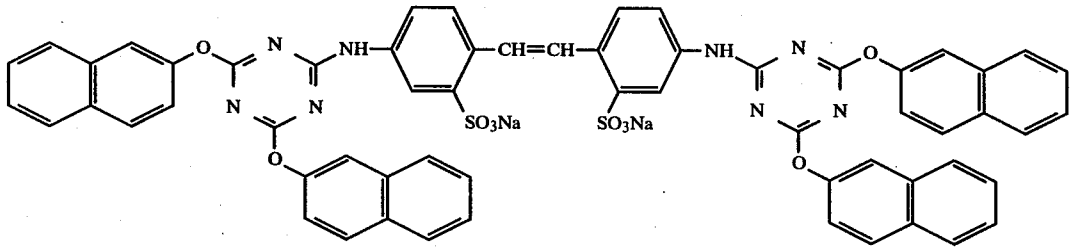
XII-13
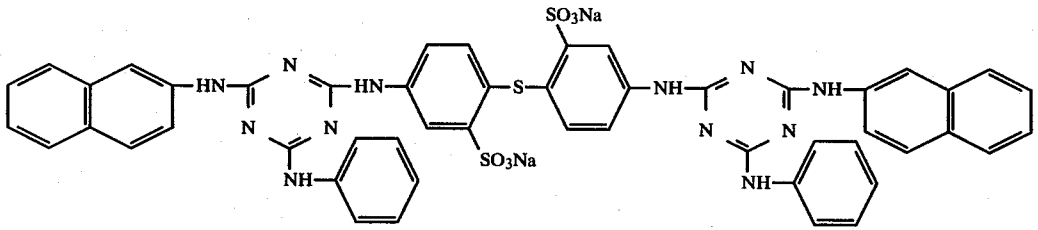
XII-14
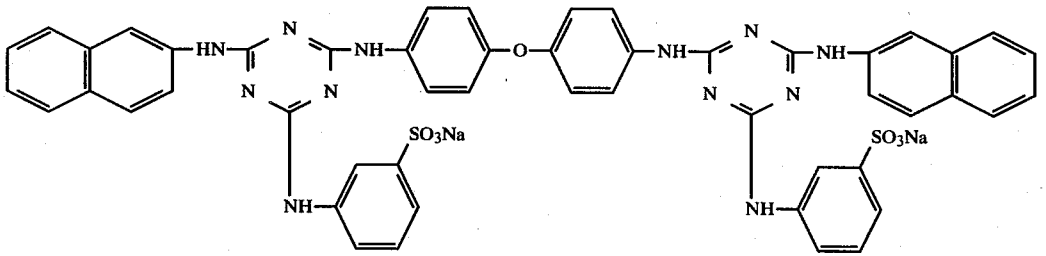

-continued
XII-15
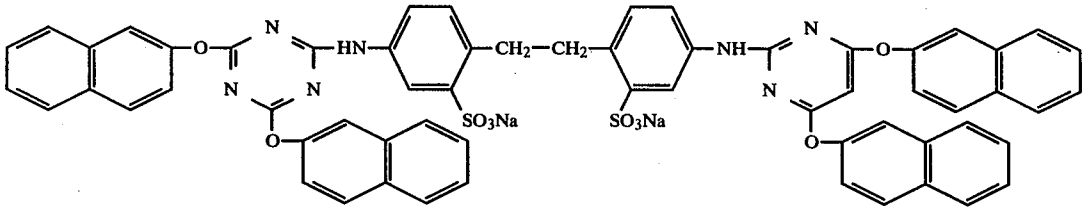
XII-16
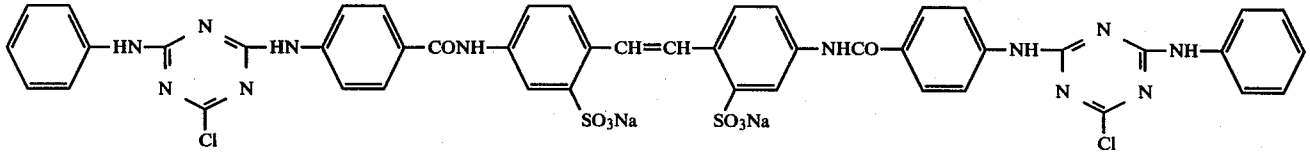
XII-17
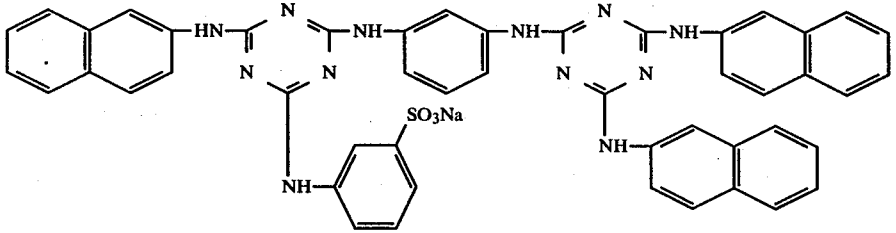
XII-18
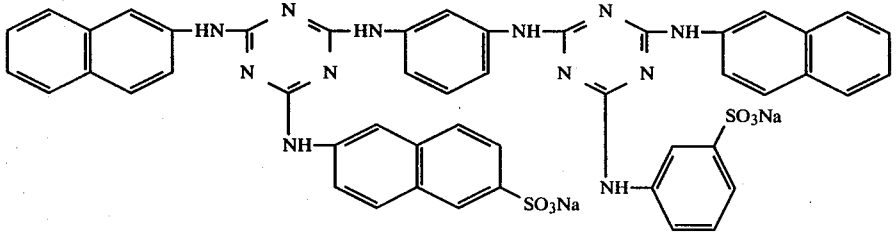

-continued
XII-19
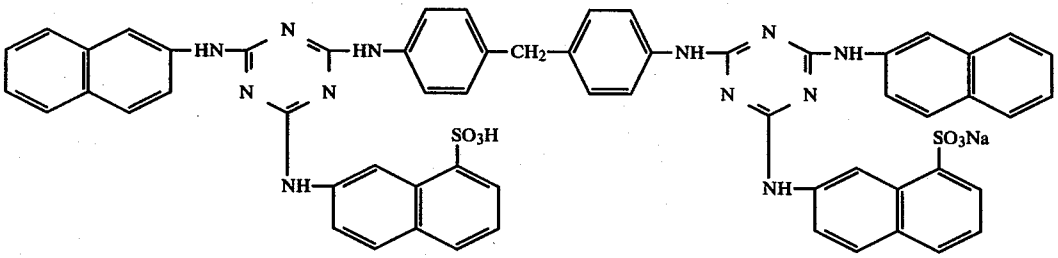
XII-20
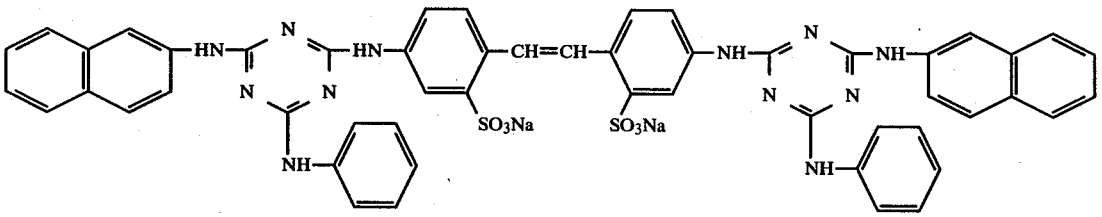
XII-21
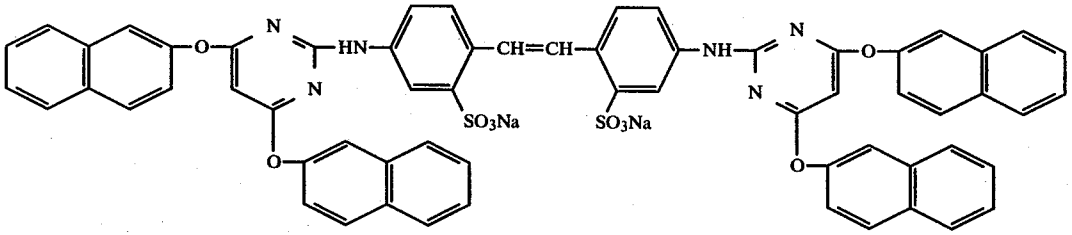
XII-22
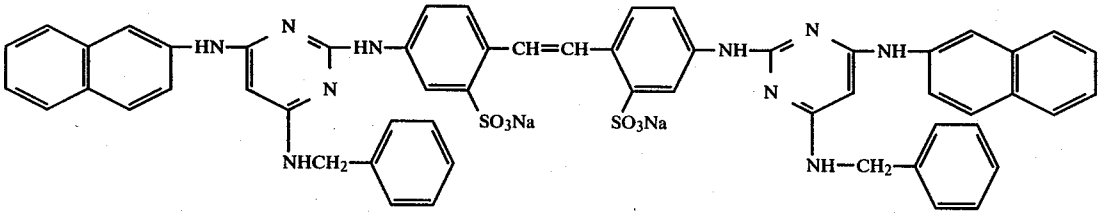

-continued
XII-23
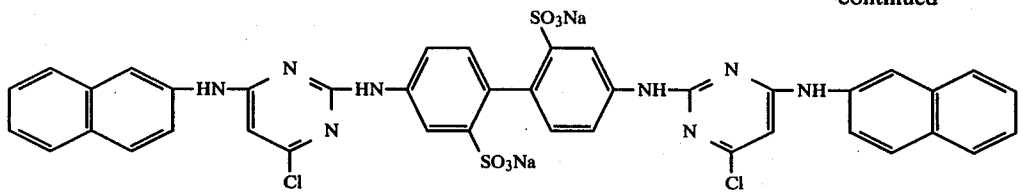
XII-24
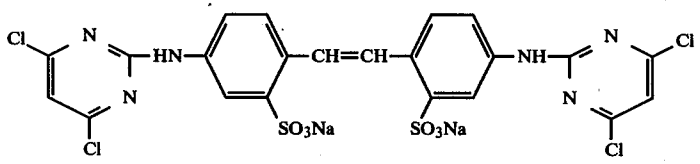

RL, GL and BL used in the present invention are arranged on the support in the following order: BL and GL; BL, RL and GL; or RL, GL and BL. A protective layer (PL) and an intermediate layer (ML) can be provided above or below each layer or between the layers, and an antihalation layer (HL) or yellow filter layer (YL) can be provided below the layers. The silver halide photosensitive layers can be divided into two or more layers such as a high-speed layer and low speed layer. The structure of the layers may be the same as that of a printing photosensitive material comprising an ordinary film or photographic printing paper as the support.

A finely pulverized organic or inorganic white pigment which contributes to the primary diffuse reflection can be incorporated in at least one of the prime layer and the layers formed thereon in an amount of as small as only 1 $g/m^2$ or less or preferably 0.5 $g/m^2$ or less. When the pigment is used in a larger amount, the excellent properties of the color image, particularly sharpness, are damaged.

The silver halide grains used in the present invention can be prepared by an acid process, neutral process or ammonia process, or a combination of these processes. For example, core grains are prepared by the acid process and they are grown by the ammonia process. In the growing process, pH and pAg are controlled to introduce only given quantities of silver ion and a halogen ion. The grain diameter is in the range of 0.05$\mu$ to 1$\mu$, preferably 0.2 to 0.8$\mu$. The system may be either monodisperse system or polydisperse system.

The silver halide grains may be pure silver chloride, silver chlorobromide, silver bromide or silver bromoiodide. Crystal habits are not limited. The silver halide can be sensitized with an active gelatin or chemically sensitized with a chemical sensitizer such as allyl thiocarbamide, cystine or a thiosulfate; a reducing sensitizer such as a polyamine or stannous chloride; a noble metal sensitizer; or a rhodium or iridium complex salt.

An antifoggant selected from the group consisting of mercaptotriazoles, mercaptotetrazoles and benzotriazoles can be incorporated in the silver halide emulsion layers.

To conduct the development rapidly, it is preferred to use a silver chlorobromide emulsion or silver chloride emulsion in combination with an antifoggant or stabilizer capable of firmly adsorbing on the silver halide grains such as a mercapto compound, nitrobenzotriazole compound or benzotriazole compound. Ordinary additives such as a development accelerator, halation-preventing agent, irradiation-preventing agent or fluorescent brightener may also be used.

The color photosensitive materials of the present invention can be used as all sorts of color photographic reflective materials, particularly photosensitive materials for color printing papers, color reversal printing papers and direct positive color printing papers as well as photosensitive materials for color copies according to photofogging process.

Color Development Process

A color developer usable in the developing process of the photosensitive material of the present invention is preferably an alkaline aqueous solution containing an aromatic primary amine color developing agent as a main component. The color developing agents are aminophenol compounds, and particularly preferably p-phenylenediamine compounds. Typical examples thereof include 3-methyl-4-amino-N,N-diethylaniline, 3-methyl-4-amino-N-ethyl-N-$\beta$-hydroxylethylaniline, 3-methyl-4-amino-N-ethyl-N-$\beta$-methanesulfonamidoethylaniline, 3-methyl-4-amino-N-methyl-N-$\beta$-methoxyethylaniline and their sulfates, hydrochlorides and p-toluenesulfonates. These diamines in the form of their salts are generally more stable than those in the free form, and the former is preferable to the latter.

The color developer contains usually a pH buffering agent such as an alkali metal carbonate, borate or phosphate; a development inhibitor such as a bromide, iodide, benzimidazole, benzothiazole or mercapto compound; and an antifoggant. The color developer may contain further, if necessary, a preservative such as a hydroxylamine or sulfite; an organic solvent such as triethanolamine or diethylene glycol; a development accelerator such as benzyl alcohol, polyethylene glycol, a quaternary ammonium salt or an amine; a dye-producing coupler; a competing coupler; a nucleating agent such as sodium boron hydride; an assistant developer such as 1-phenyl-3-pyrazolidone; a thickening agent; a chelating agent such as an aminopolycarboxylic acid, an aminopolyphosphonic acid, an alkylphosphonic acid or a phosphonocarboxylic acid; and an antioxidant as described in West German patent application (OLS) No. 2,622,950.

In the development process for a reversal color photosensitive material, a black-and-white development is conducted before the color development. The black-and-white developer contains a known black-and-white developing agent, for example, a dihydroxybenzene such as hydroquinone, a 3-pyrazolidone such as 1-phenyl-3-pyrazolidone, or an aminophenol such as N-methyl-p-aminophenol. The black-and-white developing agent can be used either singly or as a combination of them.

The photographic emulsion layers are usually bleached after the color development. The bleaching process may be conducted either simultaneously with the fixing treatment or separately from the fixing treatment. The bleaching agents usable herein include, for example, compounds of polyvalent metals such as iron (III), cobalt (III), chromium (VI) and copper (II), peracids, quinones and nitron compounds. Typical examples of the bleaching agents include ferricyanides; dichromates; organic complex salts of iron (III) or cobalt (III) such as complex salts of them with aminopolycarboxylic acids such as ethylenediaminetetraacetic acid, diethylenetriaminepentaacetic acid, nitrilotriacetic acid and 1,3-diamino-2-propanoltetraacetic acid, and organic acids such as citric acid, tartaric acid and malic acid; persulfates; manganates; and nitrosophenol. Among them, iron (III) ethylenediaminetetraacetate and persulfates are preferred from the viewpoints of rapid process and environmental pollution prevention. Iron (III) ethylenediaminetetraacetate is particularly useful in both of independent bleaching bath and combined bleach-fixing bath.

The bleaching solution and bleach-fixing bath can contain, if necessary, a bleaching accelerator. Examples of the usable bleaching accelerators include bromine ion and iodine ion; thiourea compounds described in U.S. Pat. No. 3,706,561, Japanese Patent Publication Nos. 45-8506 and 49-26586 and Japanese Patent Public Disclosure Nos. 53-32735 , 53-36233 and 53-37016; thiol compounds described in Japanese Patent Public Disclosure Nos. 53-124424, 53-95631, 53-57831, 53-32736 , 53-65732 and 54-52534 and U.S. Pat. Nos. 3,893,858; heterocyclic compounds described in Japanese Patent Public Disclosure Nos. 49-59644, 50-140129, 53-28426, 53-141623, 53-104232 and 54-35727; thioether compounds described in Japanese Patent Public Disclosure Nos. 52-20832, 55-25064 and 55-26506; tertiary amines described in Japanese Patent Public Disclosure No. 48-84440; and thiocarbamoyls described in Japanese Patent Public Disclosure No. 49-42349. They can be used either singly or as a combination of two or more of them. Among them, bromine ion, iodine ion, thiol compounds and disulfide compounds are preferred bleaching accelerators. The bleaching accelerating agents are particularly effective in the bleach-fix of the color photosensitive materials.

Examples of the fixing agents include thiosulfates, thiocyanates, thioethers, thioureas and a large amount of iodides. Among them, the thiosulfates are usually used. Sulfites, bisulfites and carbonyl/bisulfite adducts are preferred as the preservative for a bleach-fixing solution or fixing solution.

After completion of the bleach-fixing process or fixing process, usually the product is washed with water. Various known additives can be used in order to prevent the precipitation or to save water in the washing step. The additives usable herein include water softeners for preventing the precipitation such as inorganic phosphoric acids, aminopolycarboxylic acids and organic phosphoric acids; germicides and antifungal agents which inhibit the growth of bacteria, algae and molds; hardeners such as magnesium salts and aluminum salts; and surfactants used for preventing drying load or drying mark. These additives can be used if necessary. In addition, the compounds described in L. E. West. Phot. Sci. Eng., Vol. 6, pp. 344 to 359 (1965) can also be used as additives. Particularly, the addition of chelating agents and antifungal agents are effective.

In the step of water washing, two or more tanks are used to provide a countercurrent system so as to save water. The step of water washing can be replaced by the multistep countercurrent stabilization step as described in Japanese Patent Public Disclosure No. 57-8543. In such a case, 2 to 9 countercurrent baths are necessary. Various compounds are added to the stabilization bath in order to stabilize the image, in addition to the above-mentioned additives. Concrete examples of the compounds include buffering agents for controlling the pH of the film at, for example 3 to 8 (such as suitable combinations of borates, metaborates, borax, phosphates, carbonates, potassium hydroxide, sodium hydroxide, aqueous ammonia, monocarboxylic acids, dicarboxylic acids and polycarboxylic acids) and formalin. If necessary, other additives can also be used. The additives are, for example, water softeners (such as inorganic phosphoric acid, aminopolycarboxylic acids, organic phosphoric acids, aminopolyphosphonic acids and phosphonocarboxylic acids), germicides (such as benzoisothiazolinone, isothiazolone, 4-thiazolinebenzeimidazole and halogenated phenols), surfactants, fluorescent brightening agents and hardeners. They can be used either singly or as a combination of two or more of them having the same or different effects.

It is preferred to add various ammonium salts such as ammonium chloride, ammonium nitrate, ammonium sulfate, ammonium phosphate, ammonium sulfite and ammonium thiosulfate as a pH adjustor, after the processing.

The silver halide color photosensitive material of the present invention may contain a color developing agent in order to simplify and to accelerate the processing. In such a case, precursors of the color developing agents are preferably used. Examples of the precursors include indoaniline compounds described in U.S. Pat. No. 3,342,597, Schiff base-type compounds described in U.S. Pat. No. 3,342,599 and Research Disclosure Nos. 14850 and 15159, aldol compounds described in Research Disclosure No. 13924, metal complex salts described in U.S. Pat. No. 3,719,492, urethane compounds described in Japanese Patent Public Disclosure No. 53-135628 and various salts described in Japanese Patent Public Disclosure Nos. 56-6235, 56-16133, 56-59232, 56-67842, 56-83734, 56-83735, 56-83736, 56-89735, 56-81837, 56-54430, 56-106241, 56-107236, 57-97531 and 57-83565.

The silver halide color photosensitive material of the present invention may contain, if necessary, a 1-phenyl-3-pyrazolidone in order to accelerate the color development. Typical examples of the 1-phenyl-3-pyrazolidones include those described in Japanese Patent Public Disclosure Nos. 56-64339, 57-144547, 57-211147, 58-50532, 58-50536, 58-50533, 58-50534, 58-50535 and 58-115438.

The processing solutions are used at a temperature of 10° to 50° C. in the present invention. Although the standard temperature is 33° to 38° C., a higher temperature can be employed to accelerate the processing or to reduce the processing time, and a lower temperature can be employed to improve the image quality or the stability of the processing solution. The process described in West German Patent No. 2,226,770 or U.S. Pat. No. 3,674,499 wherein a cobalt intensifier or hydrogen peroxide intensifier is used for saving silver in the photosensitive material, can also be employed.

The processing baths may have, if necessary, a heater, temperature sensor, liquid level sensor, circulating pump, filter, floating lid, squeegee, etc.

The following examples will further illustrate the present invention, which by no means limit the invention.

EXAMPLE 1

11.3 g of polyethylene was mixed with 2.8 g of metallic aluminum powder (average size: 70μ). The mixture was applied to a photographic white base paper to form a laminate, i.e. a photographic support having the secondary diffuse-reflective surface. The amounts of the metallic aluminum powder were 0.1, 0.5, 1, 5, 10 and 12 $g/m^2$ to prepare Samples 1, 2, 3, 4, 5 and 6, respectively.

A polyethylene phthalate film having a thickness of 100μ was placed in a vacuum deposition device and an aluminum film having a thickness of 1,000 Å was formed on the substrate surface under a vacuum of $10^{-5}$ Torr in the same manner as in Example 1 of Japanese patent application No. 60-52788. The film was coated with a low-density polyethylene to form a polyethylene layer having a thickness of 30μ. Thus a Comparative Sample a was prepared.

As compared with the Comparative Sample a, the Samples 1 to 6 (supports of the present invention), particularly the Samples 4 and 5 were more excellent. Namely, the samples of the present invention were free of light reflection and had a metallic brightness and a wide angle of the observation.

When a photographic support prepared in the same manner as above except that the metallic aluminum powder was used in an amount of not 2.8 g but 2.0 g or 3.7 g was used, almost the similar effects were obtained.

EXAMPLE 2

The Support Samples 1 to 6 prepared in Example 1 were used. The aluminum filler layer on the support was subjected to the corona discharge. A prime layer was formed thereon with gelatin and sodium 1-hydroxy-3,5-dichloro-S-triazine (hardener). A silver chlorobromide emulsion layer (halogen composition: AgCl 67%, average grain diameter: 0.4μ) as formed usually in the preparation of photographic printing paper was formed thereon and further a protective layer was formed thereon. The amount of silver applied was 2.1 g/m$^2$. After the image exposure followed by the development with a developer (D-72; diluted to 1:2) and fixing, it was washed with water.

The same procedure as above was repeated except that a resin-coated paper used usually as the photographic printing paper (support prepared by coating the surface of a white base paper with polyethylene whitened by mixing with titanium oxide so as to provide the primary diffuse reflectivity and coating the other surface thereof with polyethylene by extrusion coating) was used. The thus prepared photographic printing paper was image-exposed, developed, fixed and washed with water to form an image.

The images formed by using the Support Samples 1 to 6 had a higher brightness in the highlights, more excellent gradation in the shades and higher sharpness than those of the Comparative Support Sample b. Surprisingly, the maximum density and shadow saturation of the former were not inferior to those of the latter.

A photosensitive material prepared from the Support Sample 4 was embedded in an epoxy resin and the resin was solidified in order to examine the unevenness on the outer surface of the aluminum layer. It was cut according to the ultramicrotomy and the section of the piece was observed with an electrom microscope. The number of unevennesses on the outer surface was 257.

EXAMPLE 3

Color reversal photographic printing papers were prepared using the Support Sample 5 and Comparative Samples a and b in the same manner as in Example 1 described in Japanese patent application No. 61-99122.

After the image exposure followed by ordinary reversal development (comprising the first development, water washing, reversal exposure, color development water washing, bleech-fix and water washing), an image was formed.

The Sample 5 according to the present invention had remarkably improved lighting and sharpness than those of the Comparative Sample b and the visual angle of observation was wider than that of the Comparative Sample a and it was free of the reflection of the light source. In particular, the gradation in shadows became excellent and an extremely excellent image having a high texture could be obtained owing to a microscopically hard gradation due to the improved sharpness, though the tone was macroscopically soft.

EXAMPLE 4

100 g of polyethylene was mixed with 30 g of an aluminum/magnesium alloy powder (weight ratio of aluminum/magnesium: 98/2, average grain diameter: 10μ, the powder particle surface being coated with polymethacrylic acid). The mixture was applied to a photographic white base paper having polyethylene lining on the back surface to form a laminate, i.e. Sample 7 of the photographic support having the secondary diffuse-reflectivity. The amount of the alloy applied was 10 g/m$^2$.

EXAMPLE 5

Silver halide emulsion (1) used in the examples of the present invention was prepared as follows:

| | | |
|---|---|---|
| (Solution 1) | | |
| $H_2O$ | | 1000 cc |
| NaCl | | 5.5 g |
| gelatin | | 32 g |
| (Solution 2) | | |
| 1 N sulfuric acid | | 24 cc |
| (Solution 3) | | |
| the following solvent for silver halide (1%) | | 3 cc |

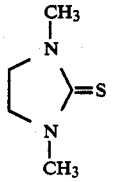

| | | |
|---|---|---|
| (Solution 4) | | |
| KBr | | 15.66 g |
| NaCl | | 3.30 g |
| $H_2O$ | ad | 200 cc |
| (Solution 5) | | |
| $AgNO_3$ | | 32 g |
| $H_2O$ | ad | 200 cc |
| (Solution 6) | | |
| KBr | | 62.72 g |
| NaCl | | 13.22 g |
| $K_2IrCl_6$ (0.001%) | | 4.54 cc |
| $H_2O$ | ad | 600 cc |
| (Solution 7) | | |
| $AgNO_3$ | | 128 g |
| $H_2O$ | ad | 600 cc |

The Solution 1 was heated at 56° C. The Solution 2 and Solution 3 were added to the Solution 1. Then the Solution 4 and Solution 5 were simultaneously added thereto over 30 min. After 10 min., the Solution 6 and Solution 7 were simultaneously added thereto over 20 min. 5 min. after completion of the addition, the temperature was lowered to conduct desalting. Water and dispersed gelatin were added thereto and the pH was adjusted to 6.2 to prepare a monodisperse silver chlorobromide emulsion comprising cubic grains having an average grain size of 0.45 μm, coefficient of variation (calculated by dividing the standard deviation by the average grain size: a/$\bar{d}$) of 0.08 and silver bromide content of 70 molar %. Sodium thiosulfate was added to the emulsion and the optimum chemical sensitization was conducted.

Silver halide emulsions (2), (3), (4) and (5) having different silver chloride contents were prepared in the same manner as above except that the amounts of KBr and NaCl in the above Solution 4 and Solution 6 and the time required for the simultaneous addition of the solution 4 and Solution 5 were modified as shown in Table 1.

TABLE 1

| | Solution 4 | | Solution 6 | | Time required for addition of |
|---|---|---|---|---|---|
| Emulsion | KBr | NaCl | KBr | NaCl | Solutions 4 and 5 |
| (2) | 6.71 g | 7.70 g | 26.88 g | 30.84 g | 12 min. |
| (3) | 3.36 g | 9.35 g | 13.44 g | 37.44 g | 10 min. |

TABLE 1-continued

| Emulsion | Solution 4 KBr | Solution 4 NaCl | Solution 6 KBr | Solution 6 NaCl | Time required for addition of Solutions 4 and 5 |
|---|---|---|---|---|---|
| (4) | 1.12 g | 10.45 g | 4.48 g | 41.85 g | 9 min. |
| (5) | 0.22 g | 10.89 g | 0.90 g | 43.61 g | 8 min. |

The average grain sizes, coefficients of variation and halogen composition in the Silver halide emulsions (1) to (5) are shown in Table 2.

TABLE 2

| Emulsion | Average grain size (m) | Coefficient of variation (s/d̄) | Halogen composition (%) Br | Halogen composition (%) Cl |
|---|---|---|---|---|
| (1) | 0.45 | 0.08 | 70 | 30 |
| (2) | 0.45 | 0.07 | 30 | 70 |
| (3) | 0.45 | 0.07 | 15 | 85 |
| (4) | 0.45 | 0.08 | 5 | 95 |
| (5) | 0.45 | 0.08 | 1 | 99 |

Support (I) of the present invention and a Comparative support (A) used in an ordinary process were prepared as follows:

Support (I): Metallic aluminum powder was mixed in polyethylene and the mixture was applied to a photographic white base paper to form a laminate white base paper. The amount of aluminum powder used was about 5 g/m$^2$. The paper was subjected to the corona discharge process and then a prime layer was formed thereon with gelatin and sodium 1-hydroxy-3,5-dichloro-S-triazine.

Comparative support (A): White fine powder of titanium dioxide was mixed previously into polyethylene in such a manner that its amount in the resulting laminate would be about 4 g/m$^2$. The mixture was applied to the surface of a photographic white base paper and, simultaneously, polyethylene was applied to the other surface of the base paper to form a laminate, i.e. RC paper. A gelatin prime layer was formed on the white polyethylene surface in the same manner as in the preparation of the Support (I).

The first to the seventh layers shown in Table 3 were formed on each support to prepare a laminate, i.e. color photographic material.

The first layer: Sensitizing dye (a) was added to Silver halide emulsion (5) in an amount of $7.0\times10^{-4}$ mol per mol of AgX to conduct the spectral sensitization. Yellow coupler (d), Color image stabilizer (e) and Solvent (f) were mixed together to obtain a solution, which was added to the emulsion in a given amount. The mixture was applied to the support to form the first layer.

The third layer: Sensitizing dye (b) was added to Silver halide emulsion (3) in an amount of $4.0\times10^{-4}$ mol per mol of AgX to conduct the spectral sensitization. Magenta coupler (h) and Color image stabilizer (i) were mixed with Solvent (j) to obtain a solution, which was added to the sensitized emulsion in a given amount. The mixture was for forming the third layer.

The fifth layer: Sensitizing dye (c) was added to Silver halide emulsion (2) in an amount of $1.0\times10^{-4}$ mol per mol of AgX to conduct the spectral sensitization. Cyan coupler (n) and Color image stabilizer (o) were mixed with Solvent (f) to obtain a solution, which was added to the sensitized emulsion in a given amount. The mixture was for forming the fifth layer.

Emulsions for forming the second layer, the fourth layer, the sixth layer and the seventh layer were prepared in the same manner as above.

The emulsions for forming the first, second, third, fourth, fifth, sixth and seventh layers were applied successively on the prime layer formed on the support to prepare Samples 1 and 2 and Comparative Sample a.

| Support | Coating composition | |
|---|---|---|
| Sample 1 | Support I | Table 1 |
| Comparative sample a | Sample A | " |

The above prepared samples were subjected to sensitometric gradation exposure through a blue/green/red separation filter or to enlargement print image exposure through a negative film by using 2854° K. light source.

After the color development, bleach fixing and rinse, a photographic image was obtained.

TABLE 3

| Layer | Main components | Amount |
|---|---|---|
| The seventh layer (protective layer) | gelatin | 1.33 g/m$^2$ |
| | Acryl-modified polyvinyl alcohol copolymer (degree of modification: 17%) | 0.17 g/m$^2$ |
| The sixth layer (U.V.-absorbing layer) | gelatin | 0.54 g/m$^2$ |
| | U.V. absorber (k) | 0.21 g/m$^2$ |
| | solvent (m) | 0.09 cc/m$^2$ |
| The fifth layer (red-sensitive layer | silver halide emulsion (2) silver: | 0.22 g/m$^2$ |
| | gelatin | 0.90 g/m$^2$ |
| | cyan coupler (n) | 0.36 g/m$^2$ |
| | color image stabilizer (o) | 0.17 g/m$^2$ |
| | solvent (f) | 0.22 cc/m$^2$ |
| | red-sensitive sensitizing dye (c) | |
| The fourth layer (U.V.-absorbing layer) | gelatin | 1.60 g/m$^2$ |
| | U.V. absorber (k) | 0.62 g/m$^2$ |
| | color mixing inhibitor (1) | 0.05 g/m$^2$ |
| | solvent (m) | 0.26 cc/m$^2$ |
| The third layer (green-sensitive layer) | silver halide emulsion (3) silver: | 0.15 g/m$^2$ |
| | gelatin | 1.80 g/m$^2$ |
| | magenta coupler (h) | 0.38 g/m$^2$ |
| | color image stabilizer (i) | 0.16 g/m$^2$ |
| | solvent (j) | 0.38 cc/m$^2$ |
| | green-sensitive sensitizing dye (b) | |
| The second layer (color-mixing inhibiting layer) | gelatin | 0.99 g/m$^2$ |
| | color-mixing inhibitor (g) | 0.08 g/m$^2$ |
| The first layer | silver halide emulsion (5) silver: | 0.26 g/m$^2$ |
| | gelatin | 1.83 g/m$^2$ |
| | yellow coupler (d) | 0.91 g/m$^2$ |
| | color image stabilizer (e) | 0.19 g/m$^2$ |
| | solvent (f) | 0.36 cc/m$^2$ |
| | blue-sensitive sensitizing dye (a) | |

(a) blue-sensitive sensitizing dye

-continued
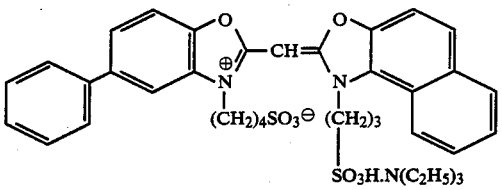
(b) green-sensitive sensitizing dye
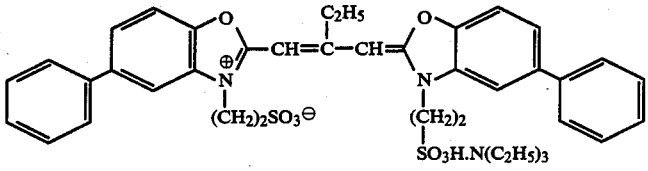
(c) red-sensitive sensitizing dye
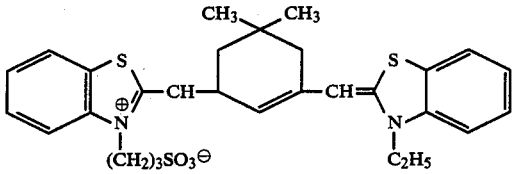
(d) yellow coupler
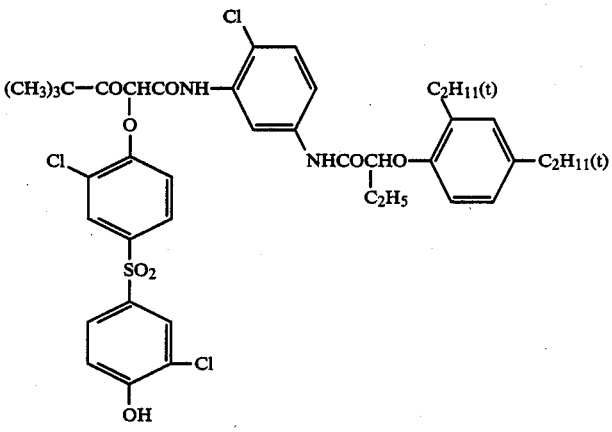
(e) color image stabilizer
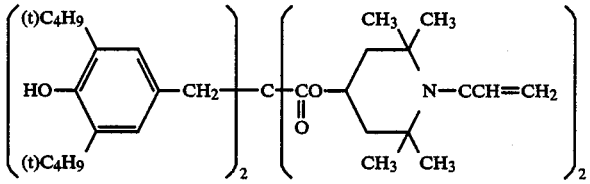
(f) solvent
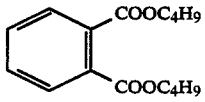
(g) color mixing inhibitor -continued
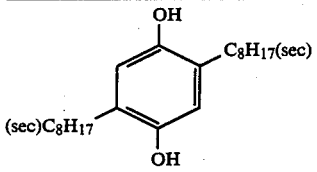
(h) magenta coupler
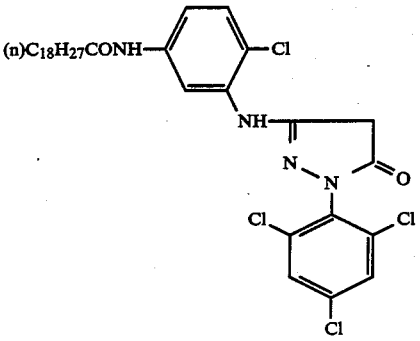
(i) color image stabilizer
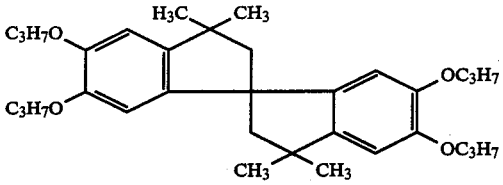
(j) solvent
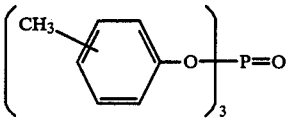
(k) I.R. absorber
mixture of
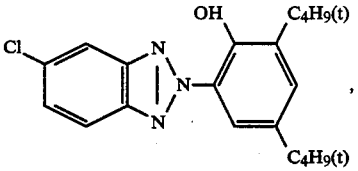
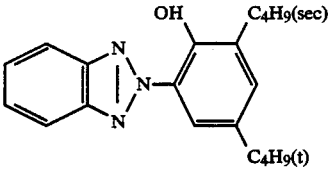
and
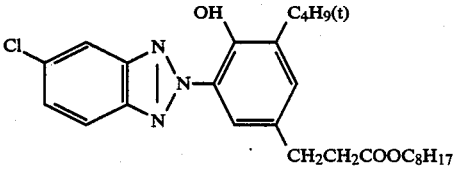
in a molar ratio of 1:5:3

-continued
(l) color-mixing inhibitor
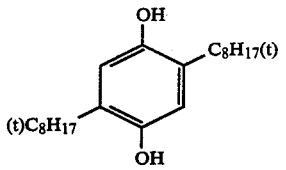
(m) solvent
(iso $C_9H_{18}O)_3P{=}O$
(n) cyan coupler
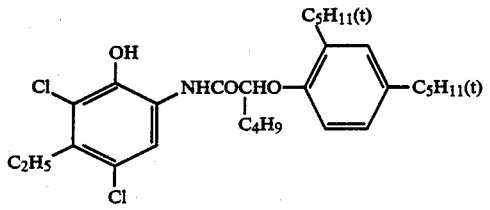
(o) color image stabilizer
mixture of
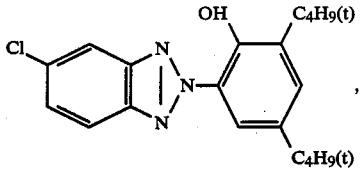
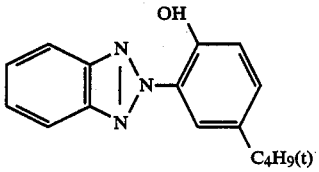
and
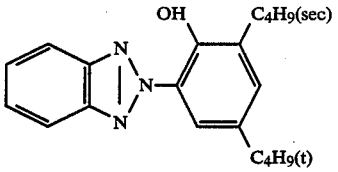
in a molar ratio of 1:3:3
(p) magenta coupler
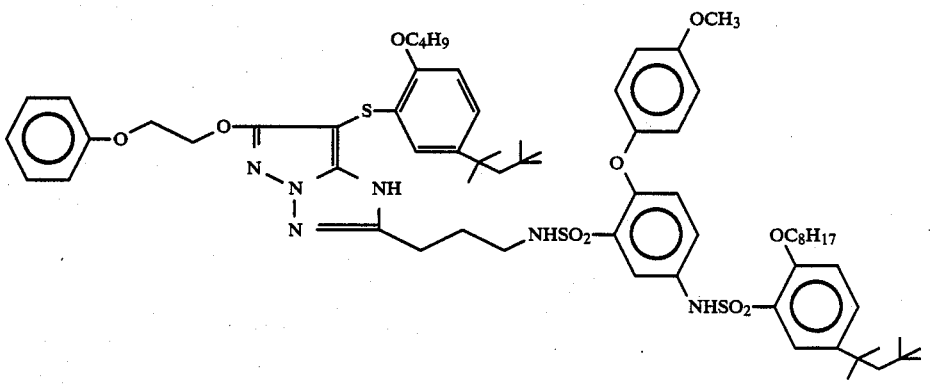

-continued (Note)

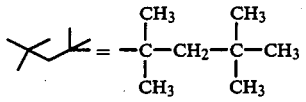

(q) cyan coupler

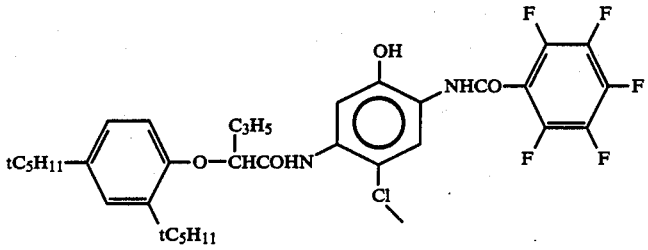

| | | | |
|---|---|---|---|
| Development | Developer A | 35° C. | 45 sec. |
| Bleach-fixing | Bleach-fixing solution A | 35° C. | 45 sec. |
| Rinsing | Rinsing solution A | 28 to 35° C. | 1 min. 30 sec. |

| | |
|---|---|
| Color developer A: | |
| water | 800 cc |
| diethylenetriaminepentaacetic acid | 1.0 g |
| sodium sulfite | 0.2 g |
| N,N—diethylenehydroxylamine | 4.2 g |
| potassium bromide | 0.6 g |
| sodium chloride | 1.5 g |
| triethanolamine | 8.0 g |
| potassium carbonate | 30 g |
| N—ethyl-N—(β-methanesulfonamidoethyl)-3-methyl-4-aminoaniline sulfate | 4.5 g |
| 4,4'-diaminostilbene fluorescent brightener (White × 4; a product of Sumitomo Chemical Co., Ltd.) | 2.0 g |
| Water | ad 1000 cc |
| pH adjusted with KOH to 10.25 | |
| Bleach-fixing solution: | |
| ammonium thiosulfate (54 wt. %) | 150 ml |
| $Na_2SO_3$ | 15 g |
| $NH_4[Fe(III)(EDTA)]$ | 55 g |
| EDTA.2Na | 4 g |
| glacial acetic acid | 8.61 g |
| water | ad 1000 ml (pH 5.4) |
| Rinsing solution A | |
| EDTA.2Na.$2H_2O$ | 04 g |
| water | ad 1000 ml (pH 7.0) |

In the visual inspection of the photographic image, it was noted that the saturation, particularly that of yellow and magenta, was quite excellent. Surprisingly, the sharpness was remarkably improved. Further, the details of the shade gradation were reproduced clearly. The results of the inspection will be shown below as the photographic physical properties.

Experimental Example 1

Figure 2:
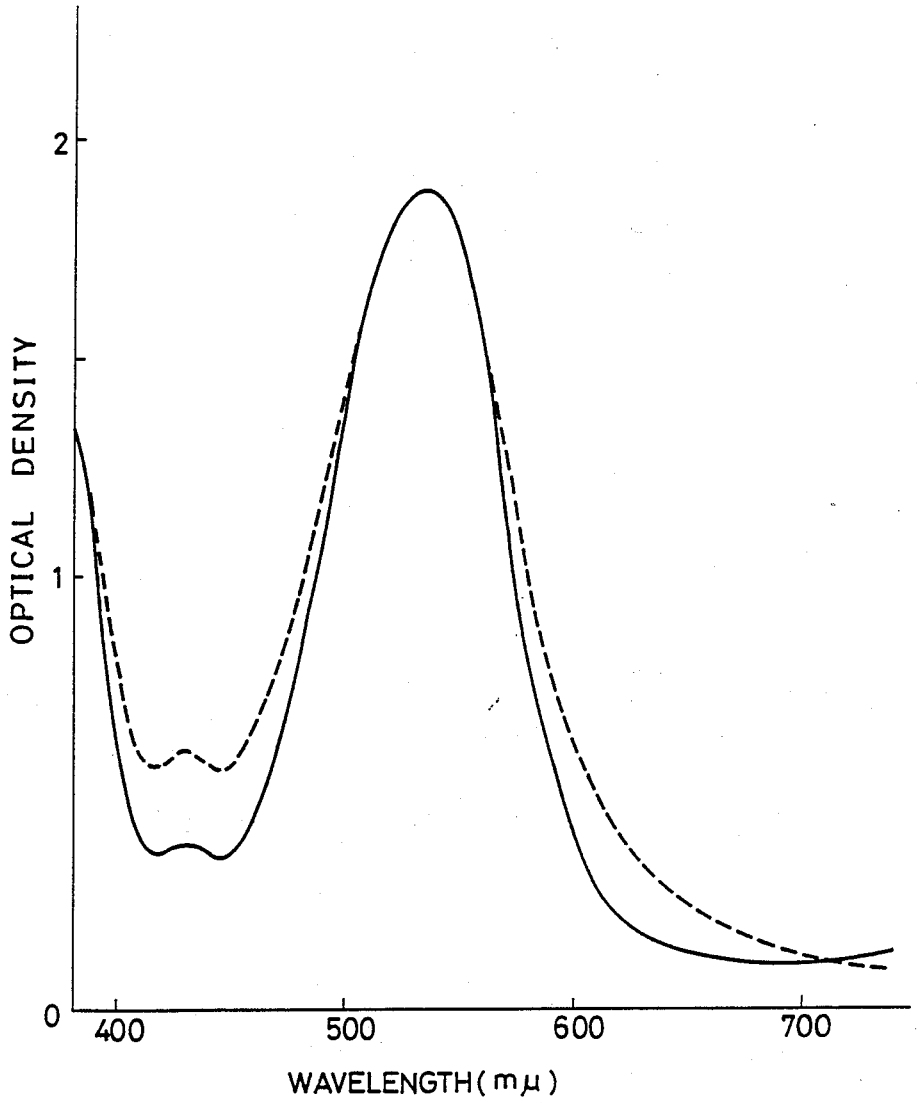
Figure 3:
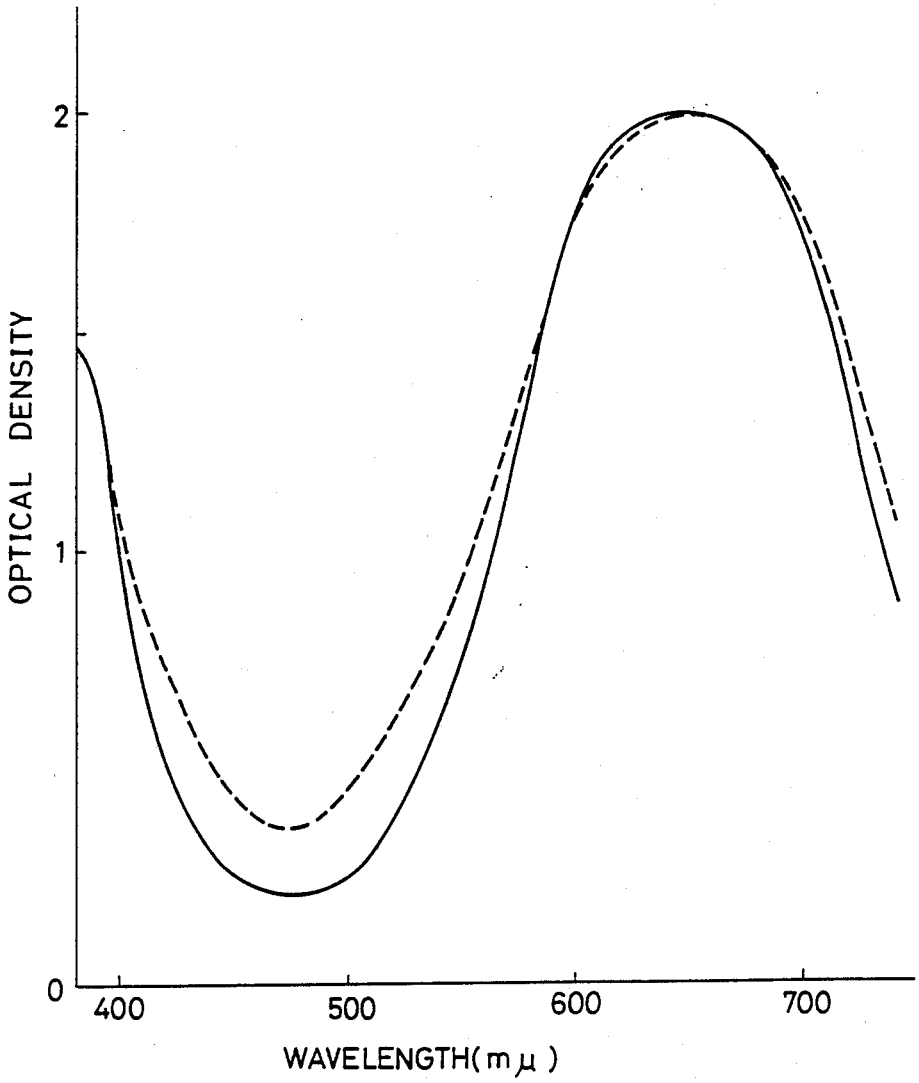
Figure 5:
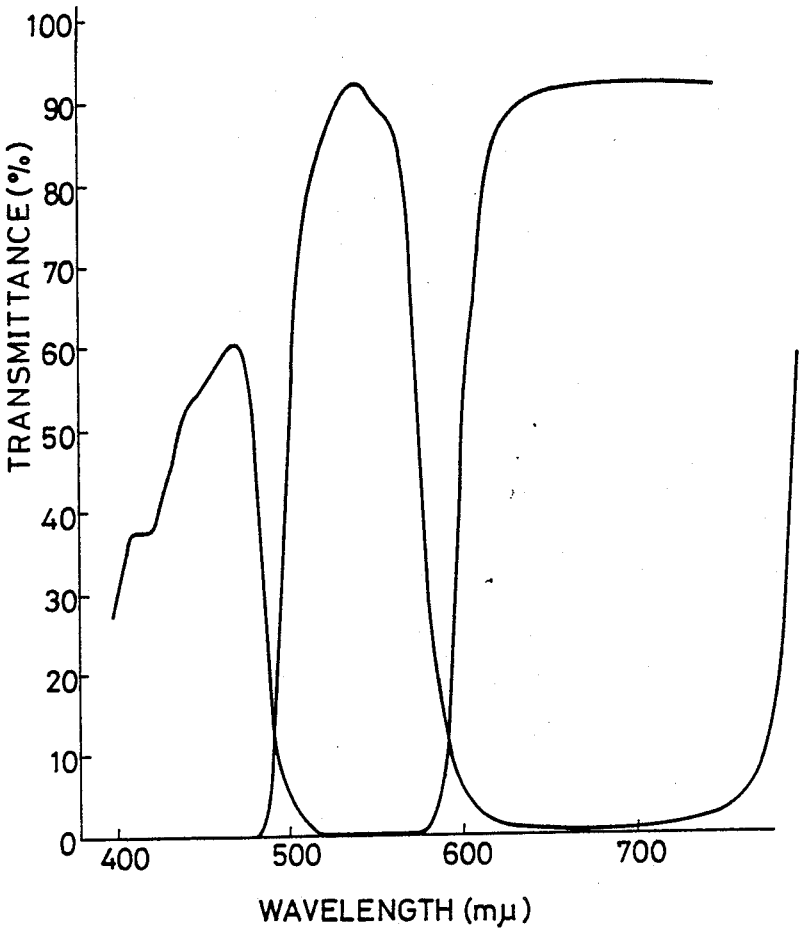
FIG. 5 shows spectral transmission curves obtained through a bandpass filter.

The Sample 1 prepared in Example 1 and Comparative sample a were subjected to the separation exposure through a band-pass filer (light source: 2854° K.). The spectral transmittance is shown in FIG. 5. After the color development, bleach-fixing and rinsing steps conducted in the same manner as in Example 1, a color image (yellow, magenta and cyan) was formed. The spectral absorption characters thereof were examined by means of Color Analyzer 307 (a product of Hitachi, Ltd.) to obtain the results shown in FIG. 1 (BL, yellow color image), FIG. 2 (GL, magenta color image) and FIG. 3 (RL, cyan color image). The results obtained by using the Sample 1 of the present invention are shown by a solid line and those obtained by using the Comparative sample a are shown by a broken line. The maximum density is represented as 1.0. It will be understood that the color image according to the present invention had a sharp spectral absorption distribution and an improved saturation.

Experimental Example 2

CTF of each of RL, GL and BL of the color photosensitive material of the present invention was determined. CTF is a ratio of a density amplitude at a frequency of substantially 0 to a density amplitude at a varied frequency.

Figure 4:
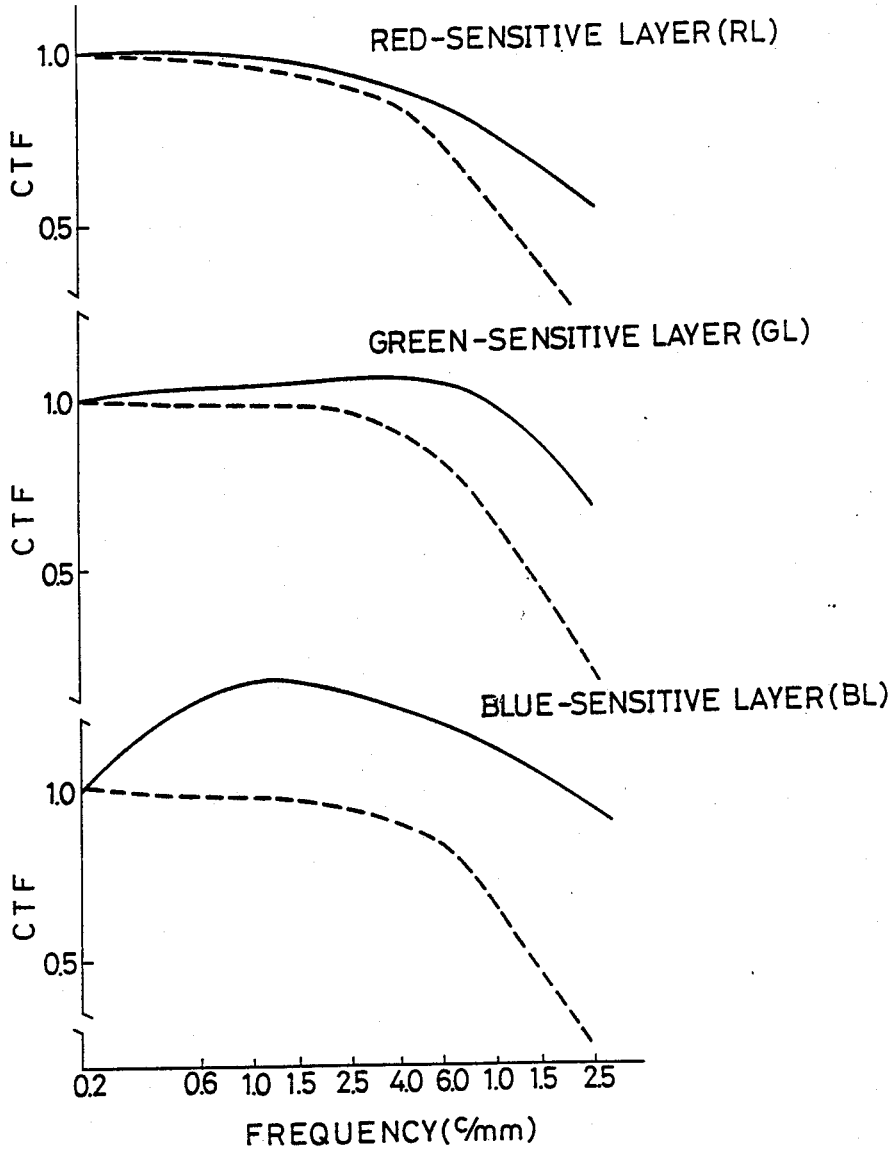
FIG. 4 shows a relationship between CTF and the frequency.

The Sample 1 of the present invention and the Comparative sample a to which a square wave chart of varied frequency was closely applied were exposed through an R, G, B separation filter and then subjected to a given development process in the same manner as in Example 1. The thus obtained image was microtraced with a microdensitometer (aperture: $2\mu \times 100\mu$ width) to obtain the results shown in FIG. 4. The results obtained by using the Sample 1 are shown by a solid line and those obtained by using the Comparative sample are shown by a broken line. These results indicated that the image obtained by using the Sample 1 of the present invention had a remarkably high sharpness. The closer the silver halide layer to the support, the higher the sharpness. This is a surprising effect.

EXAMPLE 6

A photosensitive material having a layer structure as shown in Table 4 which was to be heat-developed was prepared. Processes for preparing Emulsions (I), (VI) and (VII) and Organic silver salts (1) and (2) will be described below in detail. Then, a mordant, etc. were applied to the support of the present invention to prepare a dye-fixing material. A color image was formed on the material by the heat development.

TABLE 4

| Layer No. | Layer | Additive | Amount (g/m$^2$) |
|---|---|---|---|
| The sixth layer | Protective layer | gelatin | 0.9 |
| | | matting agent silica | 0.116 |
| | | water-soluble polymer (1) | 0.228 |
| | | surfactant (1) | 0.064 |
| | | surfactant (2) | 0.036 |
| | | hardener | 0.018 |
| | | surfactant (3) | 0.06 |
| | | surfactant (6) | 0.072 |
| The fifth layer | Green-sensitive layer | emulsion (I) | 0.4 |
| | | organic silver salt (2) silver | 0.036 |
| | | acetylene compound | 0.022 |
| | | yellow dye-donating substance (1) | 0.36 |
| | | yellow dye-donating substance (2) | 0.09 |
| | | high-boiling organic solvent (1) | 0.225 |
| | | reducing agent (1) | 0.009 |
| | | mercapto compound (1) | 0.009 |
| | | surfactant (3) | 0.06 |
| | | water-soluble polymer (2) | 0.02 |
| | | hardener | 0.013 |
| | | gelatin | 0.64 |
| | | surfactant (5) | 0.045 |
| The fourth layer | Intermediate layer | gelatin | 0.7 |
| | | $Zn(OH)_2$ | 0.3 |
| | | surfactant (1) | 0.001 |
| | | water-soluble polymer (2) | 0.03 |
| | | hardener | 0.014 |
| | | surfactant (4) | 0.029 |
| The third layer | Red-sensitive layer | emulsion (IV) | 0.21 |
| | | organic silver salt (1) silver | 0.035 |
| | | organic silver salt (2) silver | 0.035 |
| | | gelatin | 0.44 |
| | | magenta dye-donating substance | 0.3 |
| | | high-boiling organic solvent (1) | 0.15 |
| | | reducing agent (1) | 0.006 |
| | | mercapto compound (1) | 0.003 |
| | | surfactant (4) | 0.029 |
| | | water-soluble polymer (2) | 0.013 |
| | | surfactant (5) | 0.03 |
| | | hardener | 0.009 |
| The second layer | Intermediate layer | gelatin | 0.77 |
| | | $Zn(OH)_2$ | 0.3 |
| | | surfactant (4) | 0.047 |
| | | water-soluble polymer (2) | 0.038 |
| | | surfactant (1) | 0.046 |
| | | hardener | 0.016 |
| The first layer | Red-sensitive layer | emulsion (VII) | 0.26 |
| | | organic silver salt (1) silver | 0.035 |
| | | organic silver salt (2) silver | 0.035 |
| | | mercapto compound (2) | $4 \times 10^{-4}$ |
| | | sensitizing dye | $5 \times 10^{-5}$ |
| | | cyan dye-donating substance | 0.325 |
| | | high-boiling organic solvent (1) | 0.162 |
| | | reducing agent (1) | $8.7 \times 10^{-3}$ |
| | | mercapto compound (1) | 0.013 |
| | | surfactant (4) | 0.094 |
| | | surfactant (5) | 0.032 |
| | | water-soluble polymer (2) | 0.018 |
| | | gelatin | 0.5 |
| | | hardener | 0.01 |
| Support (polyethylene terephthalate; Thickness: 100$\mu$) | | | |
| Backing layer | | carbon black | 0.44 |
| | | polyester | 0.30 |
| | | polyvinyl chloride | 0.30 |

high-boiling organic solvent (1): trinonyl phosphate
water-soluble polymer (high water-absorbing polymer) (1): Sumika Gel L-5 (H) (a product of Sumitono Chemical Co.)
water-soluble polymer (high water-absorbing polymer) (2):

TABLE 4-continued
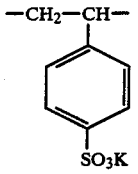
surfactant (1): Aerosol OT
surfactant (2):
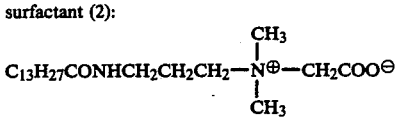
surfactant (3):
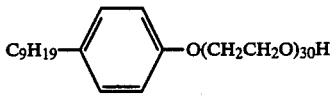
surfactant (4):
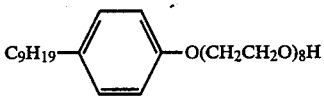
surfactant (5):
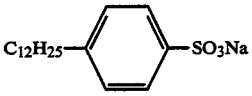
surfactant (6):
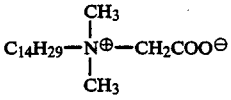
hardener: 1,2-bis(vinylsulfonylacetamido)ethane silicone oil
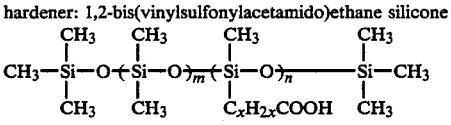
acetylene compound:
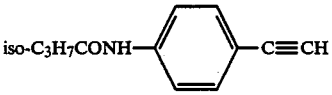
reducing agent (1):
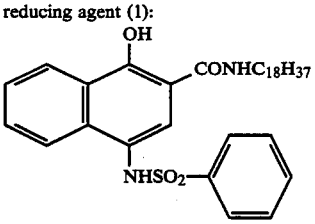
mercapto compound (1):
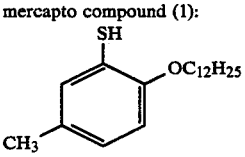
mercapto compound (2):

TABLE 4-continued

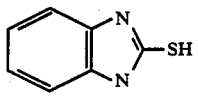

sensitizing dye:

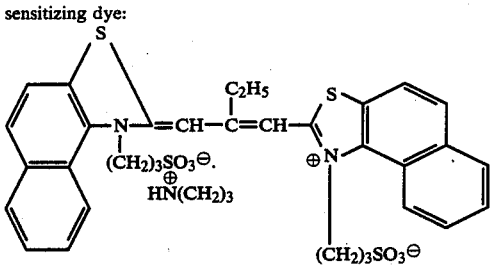

The emulsion used for forming the fifth layer was prepared as follows:

Emulsion (I):

Solutions I and II described below were added to an aqueous gelatin solution (prepared by dissolving 20 g of gelatin, 3 g of sodium chloride and 0.015 g of a compound of the formula:

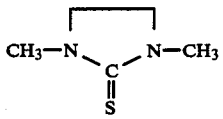

in 800 m of water and kept at 65° C.) under thorough stirring over 70 min. Simultaneously with the start of the addition of the solutions I and II, the addition of a dye solution prepared by dissolving 0.24 g of a sensitizing dye (A):

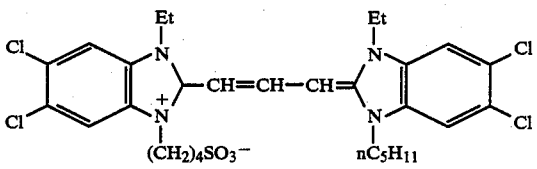

in a solution comprising 120 m of methanol and 120 m of water was also started and the addition of the latter was completed after 60 min.

| | | Solution I (600 m in total) | Solution II (600 m in total) |
|---|---|---|---|
| $AgNO_3$ | (g) | 100 | — |
| KBr | (g) | — | 56 |
| NaCl | (g) | — | 7 |

Immediately after completion of the addition of the solutions I and II, a solution of 2 g of KBr in 20 m of water was added to the reaction mixture and the mixture was left to stand for 10 min.

After water washing and desalting, 25 g of gelatin and 100 ml of water were added thereto and the pH and pAg were adjusted to 6.4 and 7.8, respectively. Thus, a disperse emulsion comprising cubic grains having a size of about 0.5μ was prepared.

The emulsion was kept at 60° C. and 1.3 mg of triethylthiourea and 100 mg of 4-hydroxy-6-methyl-1,3,3a,7-tetrazaindene were added simultaneously thereto to conduct an optimum chemical sensitization. The yield was 650 g.

The emulsion used for forming the third layer was prepared as follows:

Emulsion (VI):

Solutions I and II described below were added to an aqueous gelatin solution (prepared by dissolving 20 g of gelatin, 2 g of sodium chloride and 0.015 g of a compound of the formula:

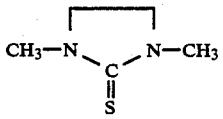

in 800 ml of water and kept at 55° C.) under thorough stirring over 60 min.

Simultaneously with the start of the addition of the solutions I and II, the addition of a dye solution prepared by dissolving 0.16 g of a sensitizing dye (B):

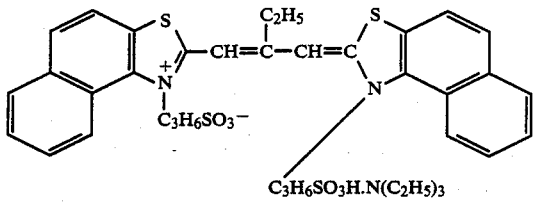

in 80 ml of methanol was also started and the addition of the latter was completed after 40 min.

| | | Solution I (600 m in total) | Solution II (600 m in total) |
|---|---|---|---|
| $AgNO_3$ | (g) | 100 | — |
| KBr | (g) | — | 56 |
| NaCl | (g) | — | 7 |

After completion of the addition of the solutions I and II, the mixture was left to stand for 10 min. and the temperature was lowered. The product was washed with water and desalted. Then 25 g of gelatin and 100 ml of water were added thereto and the pH and pAg were adjusted to 6.5 and 7.8, respectively.

Thereafter, triethylthiourea and 4-hydroxy-6-methyl-1,3,3a,7-tetrazaindene were added thereto to conduct the optimum chemical sensitization at 60° C.

Thus, a monodisperse emulsion comprising cubic grains having a size of about 0.35μ was prepared. The yield was 650 g.

The emulsion used for forming the first layer was prepared as follows:

Emulsion (VII):

600 ml of an aqueous solution containing 49 g of potassium bromide and 10.5 g of sodium chloride and an aqueous silver nitrate solution (prepared by dissolving 0.59 mol of silver nitrate in 600 ml of water) were simultaneously added at the same rate to an aqueous gelatin solution (prepared by dissolving 20 g of gelatin, 4 g of sodium chloride and 0.02 g of a compound of the formula:

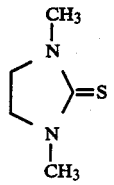

in 1,000 ml of water and kept at 60° C.) under thorough stirring over 50 min. After water washing and desalting, 25 g of gelatin and 200 ml of water were added thereto and the pH was adjusted to 6.4. The optimul chemical sensitization was conducted with triethylthiourea and 4-hydroxy-6-methyl-1,3,3a,7-tetrazaindene to prepare 700 g of a monodisperse emulsion (I) comprising cubic grains having an average grain diameter of 0.4μ.

The organic silver salts were prepared as follows:

Organic silver salt (1):

A silver/benzotriazole emulsion was prepared as follows:

28 g of gelatin and 13.2 g of benzotriazole were dissolved in 300 ml of water. The solution was stirred at 40° C. A solution of 17 g of silver nitrate in 100 ml of water was added to the solution over 2 min.

The pH of the thus prepared silver/benzotriazole emulsion was controlled to form a precipitate and thereby to remove an excess salt. The pH was adjusted to 6.30 to obtain 400 g of silver/benzotriazole emulsion.

Organic silver salt (2):

20 g of gelatin and 5.9 of 4-acetylaminophenylpropiolic acid were dissolved in 1,000 ml of 0.1% aqueous sodium hydroxide solution and 200 ml of ethanol.

The thus prepared solution was stirred at 40° C.

A solution of 4.5 g of silver nitrate in 200 ml of water was added to the solution over 5 min.

The pH of the obtained dispersion was controlled to form a precipitate and thereby to remove an excess salt. The pH was adjusted to 6.3 to obtain 300 g of a dispersion of the organic silver salt (2).

The dispersion of a dye-donating substance in gelatin was prepared as follows:

12 g of a yellow dye-donating substance (Y-1), 3 g of (Y-2), 7.5 g of a high-boiling organic solvent (1), 0.3 g of a reducing agent (1) and 0.3 g of a mercapto compound (1) were dissolved in 45 ml of ethyl acetate. The solution was stirred together with 100 g of 10% of aqueous gelatin solution and 60 ml of 2.5% aqueous sodium dodecylbenzene sulfonate. The mixture was treated in a homogenizer at 10,000 rpm for 10 min. The obtained dispersion will be referred to as a dispersion of magenta dye-donating substance. 15 g of a cyan dye-donating substance (C), 7.5 g of the high-boiling organic solvent (1), 0.4 g of the reducing agent (1) and 0.6 g of the mercapto compound (1) were dissolved in 40 ml of ethyl acetate. The solution was stirred together with 100 g of 10% gelatin solution and 60 ml of 2.5% aqueous sodium dodecylbenzenesulfonate solution. The mixture was treated in a homogenizer at 10,000 rpm for 10 min. The obtained dispersion will be referred to as a dispersion of cyan dye-donating substance.

(Y-1)

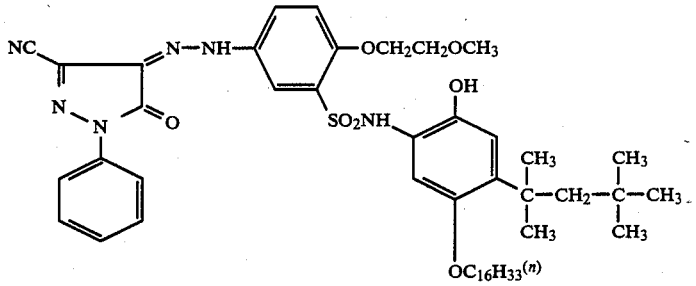

(Y-2)

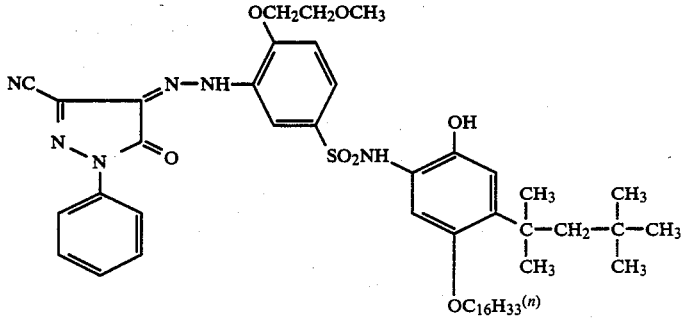

-continued (M)

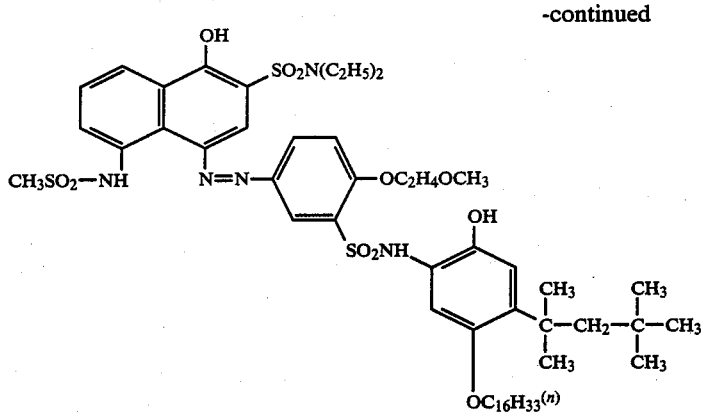

(C)

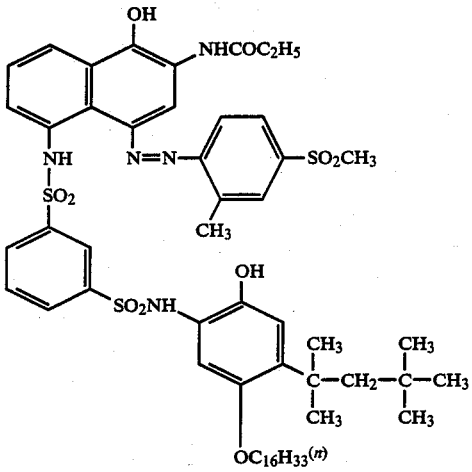

The dye-fixing material was prepared as follows:

The layers shown in the following table were formed on a photographic support of the present invention having the same gelatin prime layer as in Example 2 to prepare the dye-fixing material.

| | |
|---|---|
| The second layer | gelatin (0.7 g/m$^2$) |
| | hardener*1 (0.24 g/m$^2$) |
| The first layer | gelatin (1.4 g/m$^2$) |
| | mordant*2 (2.6 g/m$^2$) |
| | guanidium picolinate (2.5 g/m$^2$) |
| | Support |

*1 1,2-bis(vinylsulfonylacetamido)ethane

*2

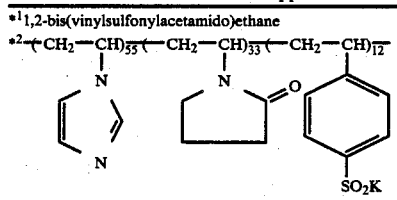

The color photosensitive material having the above-mentioned layer structure was exposed to a light of a xenon flash tube for $1/10^{-4}$ sec. through a separation filter (G, R, IR) with a continuous density change.

12 ml/m$^2$ of water was fed on the emulsion layer surface of the exposed photosensitive material with a wire bar. Thus processed material was put on the dye-fixing material in such a manner that the layer surfaces of them were brought in contact with each other. They were heated with a heat roller having a temperature controlled so that the temperature of the water-absorbed film would be 90° C. for 20 sec. The dye-fixing material was peeled out of the photosensitive material to form yellow, magenta and cyan images on the dye-fixing material corresponding to the separation filter (G, R and IR).

Thus, by using the support of the present invention, a transferred dye image having more excellent gradation and sharpness than those obtained by using an ordinary paper support the surfaces of which are laminated with polyethylene could be obtained.

What is claimed is:

1. A photographic support comprising, on a substrate, a filling layer having a secondary diffuse-reflective surface, comprising a fine solid metal powder selected from the group of aluminum, silver, gold, nickel, magnesium, or alloys thereof, and a resin, wherein said filling layer has a reflectance of at least 0.5 and wherein said metal powder has an average particle diameter of from 0.01 to 100μ and is dispersed in the resin.

2. The photographic support of claim 1 wherein the resin is selected from organic solvent resins and thermoplastic resins.

3. The photographic support of claim 1 wherein a thermoplastic resin layer or an adhesive layer is provided between the solid powder filling layer and the substrate.

4. The photographic support of claim 1 wherein the substrate is a paper.

5. The photographic support of claim 3 wherein a thermoplastic resin layer or a water-resistant resin layer is provided on the surface of the substrate opposite to the surface thereof having the filling layer comprising the fine solid powder.

6. A color photosensitive material comprising at least one silver halide emulsion layer formed on a support according to claim 1.

7. The color photosensitive material of claim 6 wherein the resin is selected from organic solvent resins and thermoplastic resins.

8. The color photosensitive material of claim 6 wherein a thermoplastic resin layer or an adhesive layer is provided between the solid powder filling layer and the substrate.

9. The color photosensitive material of claim 6 wherein the substrate is a paper.

10. The color photosensitive material of claim 8 wherein a thermoplastic resin layer or a water-resistant resin layer is provided on the surface of the substrate opposite to the surface thereof having the filling layer comprising the fine solid powder.

11. The color photosensitive material of claim 6 having two or more silver halide emulsion layers having different spectral sensitivities.

12. The color photosensitive material of claim 11 which comprises an emulsion layer (BL) containing silver halide grains having a spectral sensitivity in a wavelength region of 400 to 500 mμ and finely dispersed yellow color coupler droplets, an emulsion layer (GL) containing silver halide grains having a spectral sensitivity in a wavelength region of 500 to 580 mμ and finely dispersed magenta color coupler droplets and an emulsion layer (RL) containing silver halide grains having a spectral sensitivity in a wavelength region of 580 to 740 mμ and finely dispersed cyan color coupler droplets in any order.

13. A photographic support comprising, on a substrate, a filling layer having a secondary diffuse-reflective surface, comprising a fine solid metal powder and a resin, wherein said filling layer has a reflectance ranging from 0.7 to 1.0 and wherein said metal powder has an average particle diameter of from 0.01 to 100 μm and is dispersed in the resin.

14. The photographic support of claim 13 wherein the resin is selected from organic solvent resins and thermoplastic resins.

15. The photographic support of claim 13 wherein a thermoplastic resin layer or an adhesive layer is provided between the solid powder filling layer and the substrate.

16. The photographic support of claim 13 wherein the substrate is paper.

17. The photographic support of claim 15 wherein a thermoplastic resin layer or a water-resistant resin layer is provided on the surface of the substrate opposite to the surface thereof having the filling layer comprising the fine solid powder.

18. The photographic support of claim 13 wherein the metal powder is a powder selected from the group of aluminum, silver, gold, nickel, magnesium or alloys thereof.

19. A color photosensitive material comprising at least one silver halide emulsion layer formed on a support according to claim 13.

* * * * *